US008997678B2

(12) United States Patent
Spickermann et al.

(10) Patent No.: US 8,997,678 B2
(45) Date of Patent: Apr. 7, 2015

(54) UNDERWATER LOAD-CARRIER

(75) Inventors: Ralph Spickermann, Redwood City, CA (US); Steve N. Persall, San Jose, CA (US)

(73) Assignee: Lockheed Martin Corporation, Bethesda, MD (US)

( * ) Notice: Subject to any disclaimer, the term of this patent is extended or adjusted under 35 U.S.C. 154(b) by 304 days.

(21) Appl. No.: 13/370,816

(22) Filed: Feb. 10, 2012

(65) Prior Publication Data

US 2013/0206049 A1 Aug. 15, 2013

(51) Int. Cl.

| | |
|---|---|
| ***B63G 8/40*** | (2006.01) |
| ***B63G 8/14*** | (2006.01) |
| ***B63G 8/24*** | (2006.01) |
| *E02F 7/00* | (2006.01) |

(52) U.S. Cl.

CPC .. *B63G 8/24* (2013.01); *E02F 7/005* (2013.01)

(58) Field of Classification Search

CPC ..... B63C 11/48; B63G 2008/004; B63G 2008/001; E02F 7/005

USPC ..... 114/312, 326–329, 331, 121, 124

See application file for complete search history.

(56) References Cited

U.S. PATENT DOCUMENTS

| | | | | |
|---|---|---|---|---|
| 3,045,623 A | | 7/1962 | Tyler | |
| 3,158,994 A | * | 12/1964 | Hodgson | 60/220 |
| 3,220,372 A | * | 11/1965 | Lehmann | 114/321 |
| 3,314,174 A | | 4/1967 | Haggard | |
| 3,415,068 A | | 12/1968 | Casey, Jr. et al. | |
| 3,667,415 A | * | 6/1972 | Robbins, Jr. | 114/333 |
| 3,697,134 A | | 10/1972 | Murray | |
| 3,812,922 A | | 5/1974 | Stechler | |
| 3,975,054 A | | 8/1976 | Brockett, III et al. | |
| 4,010,560 A | | 3/1977 | Diggs | |
| 4,231,171 A | | 11/1980 | Balligand et al. | |
| 4,232,903 A | | 11/1980 | Welling et al. | |
| 4,336,662 A | | 6/1982 | Baird | |

(Continued)

FOREIGN PATENT DOCUMENTS

| | | | | |
|---|---|---|---|---|
| EP | 1 695 619 A1 | | 8/2006 | |
| JP | 54113192 A | * | 9/1979 | B63B 43/08 |

OTHER PUBLICATIONS

US Navy, Trieste Brochure, archieved Dec. 6, 2010, http://web.archive.org/web/20101206120120/http://www.history.navy.mil/special%20Highlights/Exploration/trieste-brochure.pdf.*

(Continued)

*Primary Examiner* — S. Joseph Morano
*Assistant Examiner* — Andrew Polay
(74) *Attorney, Agent, or Firm* — Oblon, McClelland, Maier & Neustadt, L.L.P.

(57) ABSTRACT

An underwater load-carrier is disclosed that includes an underwater-balloon detachably attached to a container that is loaded with ballast. The underwater load-carrier is lowered into the water of an ocean and allowed to descend to the ocean bottom and there connected a mining-vehicle. The mining-vehicle loads mined nodules into the container while the container ejects ballast to maintain the container at a specified altitude above the ocean bottom. When nodule loading is complete, nodules and/or ballast is ejected to allow underwater load-carrier to rise to the ocean surface where mined nodules is unloaded from the container.

9 Claims, 19 Drawing Sheets

(56) References Cited

U.S. PATENT DOCUMENTS

| | | | | |
|---|---|---|---|---|
| 4,343,098 | A | 8/1982 | Balligand et al. | |
| 4,357,764 | A | 11/1982 | Lemercier et al. | |
| 4,368,923 | A | 1/1983 | Handa et al. | |
| 4,446,636 | A | 5/1984 | Weinert | |
| 4,448,145 | A | 5/1984 | Hervieu | |
| 4,498,408 | A | 2/1985 | Otteblad et al. | |
| 4,717,092 | A * | 1/1988 | Cameron | 244/33 |
| 4,722,498 | A * | 2/1988 | Cameron | 244/153 R |
| 5,328,250 | A | 7/1994 | Upright | |
| 6,371,041 | B1 | 4/2002 | Ness | |
| 8,385,155 | B2 * | 2/2013 | Stacey et al. | 367/157 |
| 2011/0010967 | A1 | 1/2011 | Howard et al. | |

OTHER PUBLICATIONS

US Navy, archieved Jul. 14, 2010, Photo #: NH 96799, Photo #: NH 96807, http://web.archive.org/web/20100714054820/http://www.history.navy.mil/photos/sh-usn/usnsh-t/trste-b.htm.*

Popular Mechanics, Mar. 1954, http://books.google.com/books?id=oN0DAAAAMBAJ&pg=PA110&dq=1954+Popular+Mechanics+January&h1=en&sa=X&ei=TV0mT-7WMoGftwfi4dizCg&ved=0CEwQ6AEwBw#v=onepage&q=1954%20Popular%20Mechanics%20January&f=true.*

International Search Report and Written Opinion issued on Jul. 16, 2013 in PCT/US2013/025552 filed on Feb. 11, 2013.

* cited by examiner

UNDERWATER LOAD-CARRIER

BACKGROUND

Underwater mining includes mining nodules lying on the bottom surface of an ocean. Nodules contain valuable minerals such as manganese. Underwater mining operation includes mining the nodules and bringing the nodules to a surface ship to be processed or transported to a processing location.

SUMMARY

An underwater load-carrier (load-carrier) is disclosed that includes an underwater-balloon detachably attached to a container. The container is initially loaded with ballast through a loading hose connected to a connector disposed on a top surface of a hopper of the container. The ballast may be salt in a solid form (salt), tailings, which are waste product of a mineral extraction process, or salt and tailings as a mixture or in alloy form. The container loaded with ballast is lowered into the water of an ocean from a ship platform, attached to the underwater-balloon, and allowed to descend to an ocean bottom. At the ocean bottom, a remotely operated vehicle (ROV) connects the load-carrier to a mining-vehicle by an umbilical cord through which nodules are loaded into, power is supplied to, and communication is established with the container.

The container includes a controller that controls ejectors such as screws. The controller controls a buoyancy of the load-carrier and a load in the container (everything that is not part of the container) by ejecting ballast while the mining-vehicle loads nodules into the container. In this way, the controller adjusts the buoyancy of the load-carrier and the load to maintain a positive altitude of the load-carrier above the ocean bottom. Ejectors include detectors that detect whether nodules or ballast are being ejected. When nodules are ejected, then loading of nodules into the container may be stopped. Where more than one ejector is installed, loading of nodules may be stopped when all ejectors are ejecting nodules.

When nodule loading is completed, the container further ejects nodules and/or ballast until load-carrier reaches a desired buoyancy sufficient to ascend the load-carrier at a desired speed. The ROV disconnects the container from the mining-vehicle and the load carrier lifts the load of nodules to an ocean surface. After surfacing, the container is hoisted onto the ship platform and nodules are unloaded into a cargo hold of the ship. The container is reloaded with ballast and lowered back into the ocean to continue the underwater mining operation.

The container includes a frame having the hopper disposed between two sides and a pair of feet, one foot on each side, for example. The hopper walls may be perforated to allow ocean water to flow through the hopper to reduce mixing water from different levels of the ocean. Control surfaces are mounted on the frame and/or hopper to steer the load-carrier to a desired landing position on the ocean bottom or a target position on the ocean surface. The hopper is disposed well above the feet so that ballast ejection may not be impeded after landing on the ocean bottom. The feet are shaped to support the load-carrier with a loaded hopper and to resist lateral movement after landing so that water currents may not sweep away the landed load-carrier.

The underwater-balloon is filled with buoyant objects such as empty glass and/or ceramic balls loaded on a rack. An external shape of the underwater-balloon is formed by a covering material that is light and tough to withstand underwater mining environment. The shape forms a front profile that is smaller than a side profile. Additionally, fins are formed at a back end so that the underwater-balloon naturally orients the smaller front profile in a direction of a water current. Thus, effects of water current on a position of the load-carrier are reduced. This shape also reduces drag on a towing vehicle when the underwater-balloon is towed above water or under water.

BRIEF DESCRIPTION OF THE DRAWINGS

Exemplary embodiments are described in detail below with reference to the accompanying drawings wherein like numerals reference like elements, and wherein.

DETAILED DESCRIPTION OF EMBODIMENTS

Figure 1:
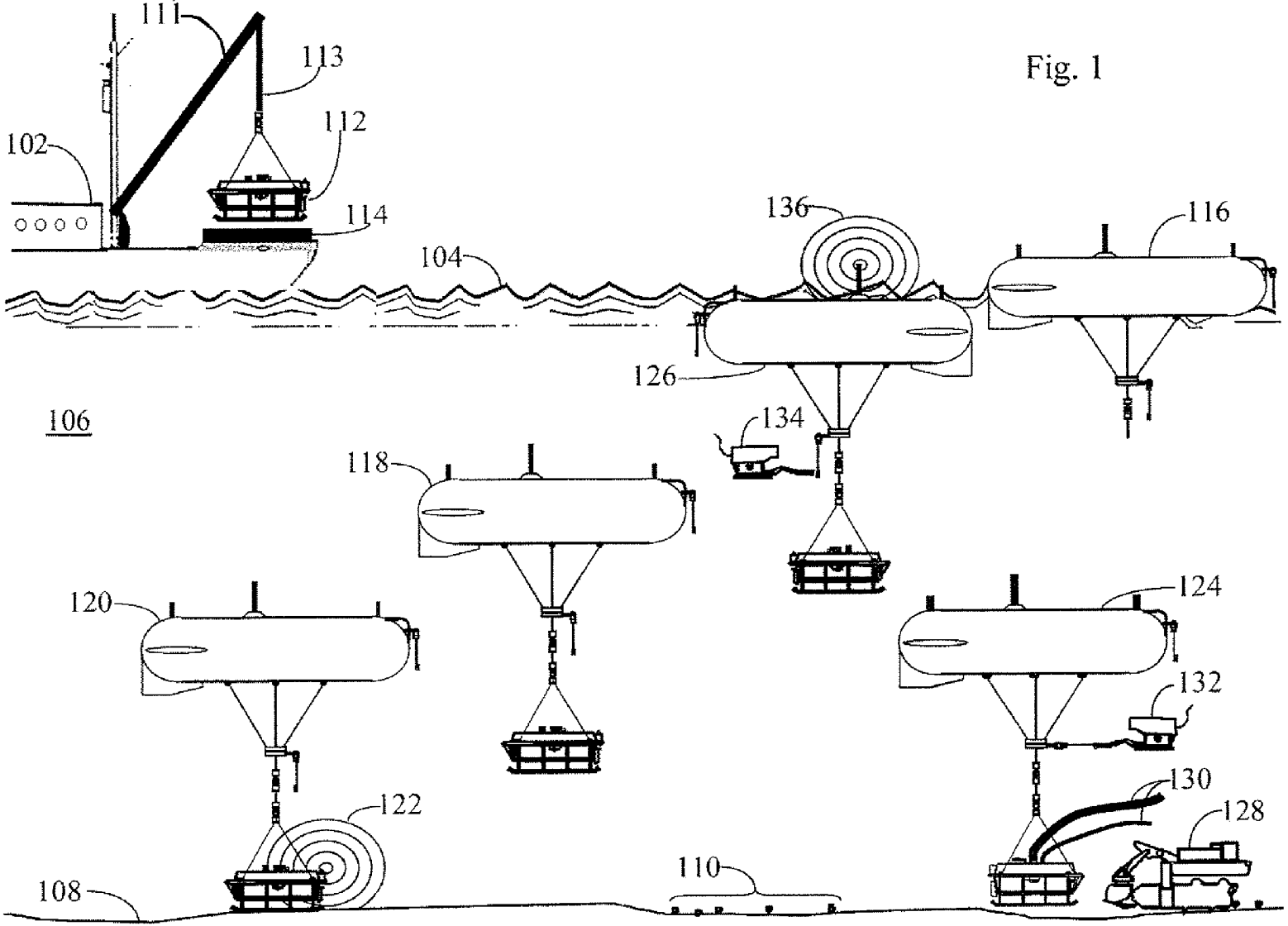
FIG. 1 shows an exemplary diagram of an underwater mining operation.

FIG. 1 shows an exemplary underwater-mining process that includes the operation of a ship 102 floating on a surface 104 of an ocean 106, load-carriers 118, 120, 124, and 126 that are in various stages of the process, a mining-vehicle 128, and remotely operated vehicles (ROVs) 132 and 134. Mining-vehicle 128 and ROVs 132 and 134 may be connected to ship 102 via cables that supply power to mining-vehicle 128 and ROVs 132 and 134, and a communication link to an operator in ship 102. Each load-carrier 118-126 includes an underwater-balloon 116 removably-attached to a container 112. Container 112 may be detached from underwater-balloon 116 and attached via a hoist line 113 to a hoist 111 of ship 102 that positions container 112 onto a platform 114 of ship 102.

Figure 2:
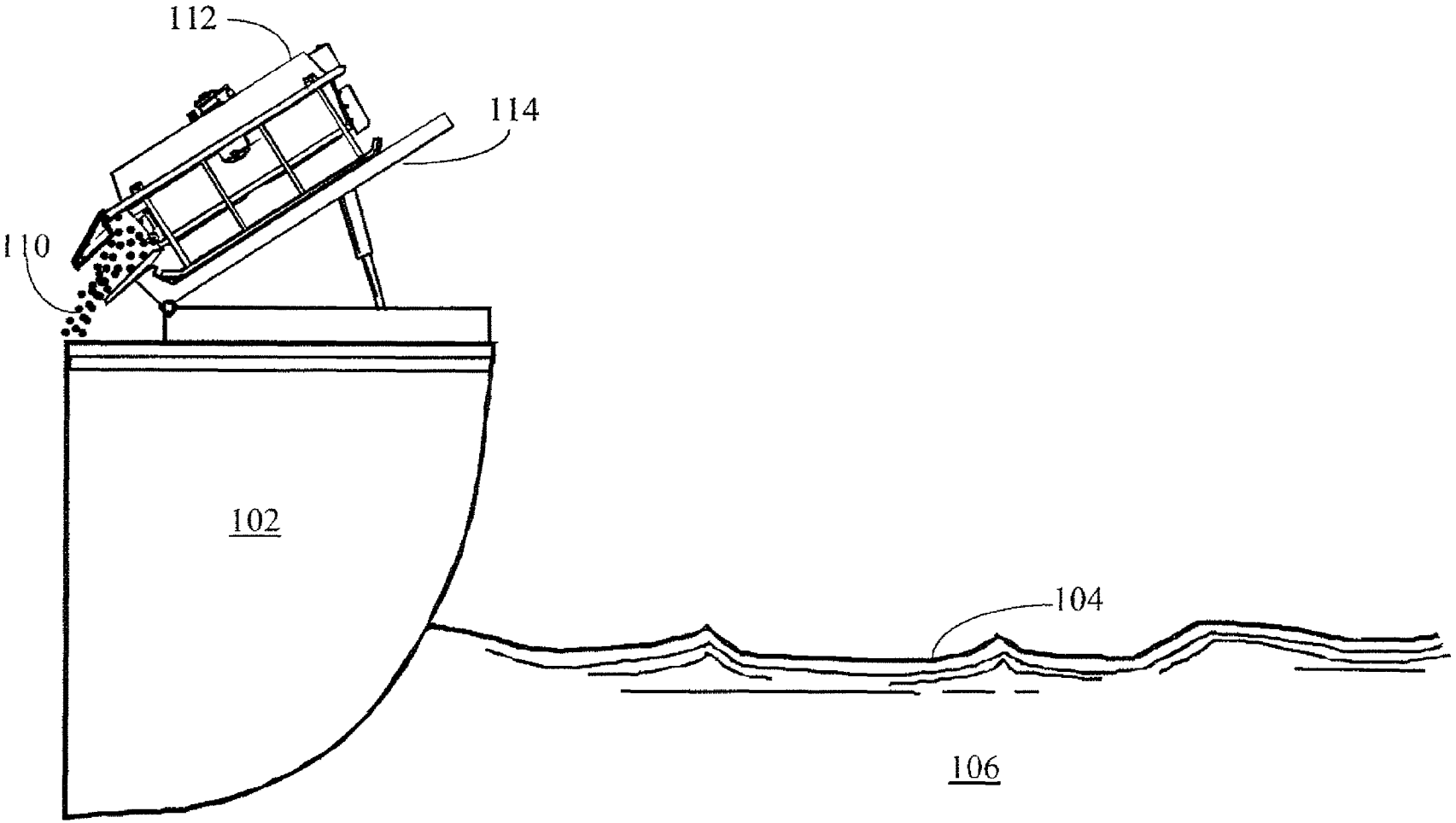
FIG. 2 shows an exemplary diagram of a ship platform tilting to empty nodules from a container.
Figure 3:
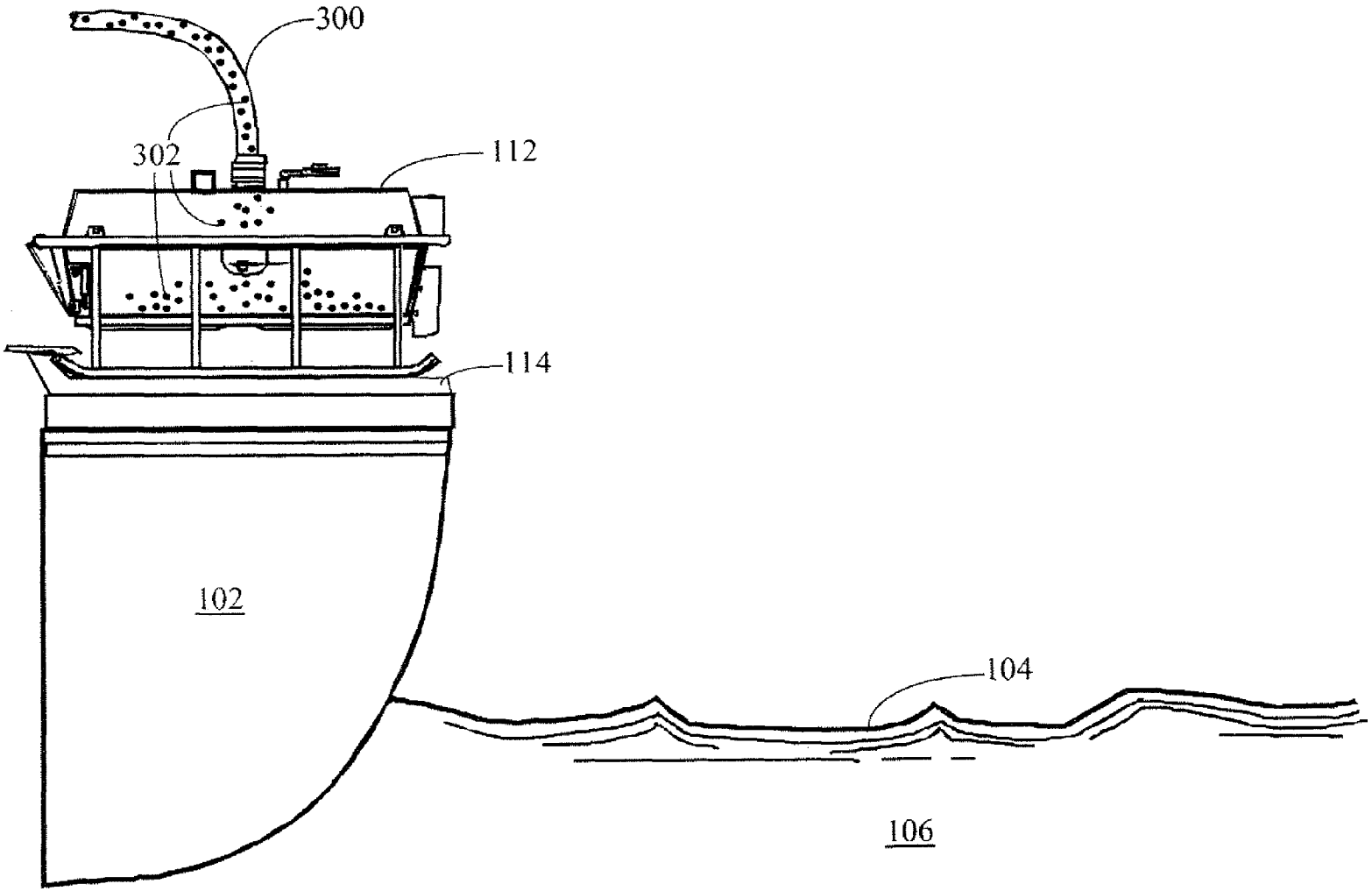
FIG. 3 shows an exemplary diagram of loading the container with ballast material.

FIG. 2 shows container 112 disposed on platform 114 in a tilted position to unload nodules 110 mined from a bottom 108 of ocean 106 into a cargo hold of ship 102. As shown in FIG. 3, after unloading nodules 110, a loading hose 300 is connected to container 112, and salt in a solid form (salt) 302 is loaded into container 112 as ballast material. Salt 302 may be distilled from ocean water into solid form so that when ejected from container 112 into the water of ocean 106, salt 302 may dissolve and cause little environmental disturbances. After salt 302 is loaded, loading hose 300 is disconnected, container 112 is hoisted into the water of ocean 106 and attached to an underwater-balloon 116 to form load-carrier 118 loaded with salt 302. At this time, load-carrier 118 has a specific gravity greater than a specific gravity of the water of ocean 106 enabling load-carrier 118 to descend into ocean 106.

Although salt 302 is used as ballast material above, tailings, a mixture of tailings and salt, or an alloy of tailings and salt may also be used. Tailings are parts of nodules 110 that are discarded after the desired minerals are extracted from nodules 110. Although salt 302 is used below to be the ballast material for ease of discussion, it should be understood that tailings or tailings and salt 302 in a mixture or alloy also may be used as ballast material.

During descent, container 112 determines a location of a target position at bottom 108 and steers load-carrier 118 toward the target position using various control surfaces mounted on container 112. The target position may be established by a homing sonar signal emitted from a landing site, for example. Although power may not be available during descent to drive load-carrier 118, container 112 may have enough power from a battery to actively control the control surfaces to counter water currents so that load-carrier 118 may land at bottom 108 closer to the target position than it would otherwise.

When load-carrier 118 lands at bottom 108, it becomes load-carrier 120. After landing, container 112 transmits a tracking signal 122 so that load-carrier 120 can be located and prepared for mining nodules. The tracking signal may be a sonar signal, for example.

Returning to FIG. 1, ROV 132 and mining-vehicle 128 converts load-carrier 120 into load-carrier 124 by connecting container 112 to mining-vehicle 128 via one or more umbilical cords 130. Umbilical cords 130 may be between about 50-100 meters long depending on, for example, traveling speeds of mining-vehicle 128 and ROV 132, a rate at which mining-vehicle 128 can load nodules 110 into container 112, and a rate at which container 112 can eject salt 302. A first umbilical cord 130 may be a loading hose connected to a connector for loading nodules 110 that are mined from bottom 108, for example. A second umbilical cord 130 may be connected to a power connector for container 112 to receive power from mining-vehicle. For example, container 112 may include one or more ejectors that are driven by power from the mining-vehicle 128 to eject salt 302 from container 112 for adjusting buoyancy of load-carrier 124 as nodules 110 are loaded into container 112. Hydraulic or electrical power may be provided by mining-vehicle 128 to power the ejectors while mining nodules 110.

A third umbilical cord 130 may be coax, fiber, twisted pair, and/or other types of a communication cable to provide communication between an operator via the mining-vehicle 128 and container 112. For example, container 112 may request a lower loading rate of nodules 110 so that ejectors can eject ballast at a sufficient rate to properly adjust buoyancy of load-carrier 124. Also, container 112 may communicate a fill status of container 112, for example. If container 112 is full, then mining-vehicle 128 may stop further loading nodules 110 into container 112. Then, container 112 may execute a procedure for ascending to surface 104, and ROV 132 may proceed to convert load-carrier 124 into load-carrier 118 by disconnecting umbilical cords 130 from container 112. Other types of communication may be required such as container 112 issuing a distress signal if salt 302 is jammed in an ejector, for example.

Third umbilical cord 130 may be replaced by a wireless sonar channel. However, there may be other containers 112 operating in close proximity and sonar bandwidth must be shared with tracking signals of other landed load-carriers 120. Communication techniques such as frequency-shift-keying may be used, but where possible, hard communication connections may be preferred.

Although three different types of umbilical cords 130 are discussed above, a single umbilical cord 130 may be provided that performs the functions of all three umbilical cords 130. For example, the functions of all three umbilical cords 130 may be combined into one umbilical cord 130 by cladding a loading hose with a material that provides power together with a communication link between container 112 and mining-vehicle 128. Alternatively, the described umbilical cords 130 may be bundled together to form the single umbilical cord 130 sharing a single connector interface that connects all functions in a single connection action to container 112. Also other functions may be performed such as a charging umbilical cord 130 to charge a battery on-board container 112 and/or a battery on-board underwater-balloon 116, for example.

During mining operations, load-carrier 124 is towed by ROV 132 to follow mining-vehicle 128 within a distance allowed by umbilical cords 130. To facilitate towing, container 112 maintains buoyancy of load-carrier 124 by ejecting salt 302 from container 112 so that load-carrier 124 floats within a specified altitude above bottom 108. As nodules 110 are loaded from a top of container 112, salt 302 is ejected from a bottom of container 112 until container 112 detects that nodules are being ejected. At this time, container 112 generates a signal indicating that container 112 is full and requests that further loading of nodules 110 be stopped.

After receiving the stop signal from container 112, mining-vehicle 128 stops further loading of nodules 110. An operator may then move ROV 132 in position to disconnect umbilical cords 130 and command container 112 and underwater-balloon 116 to prepare for ascending to surface 104. Container 112 may prepare for ascent by ejecting further nodules 110 and/or salt 302 to adjust buoyancy of load-carrier 124. In this way, a load of mined nodules 110, any remaining ballast material, and load-carrier 124 have a specific gravity less than that of the water of ocean 106. After the buoyancy adjustment is completed, container 112 issues an ejection-complete signal while load-carrier 124 begins to ascend. At this time, ROV 132 disconnects umbilical cords 130 from container 112, and load-carrier 124 becomes load-carrier 118 again, now loaded with mined nodules 110.

On ascent, container 112 determines a load-carrier position relative to a surface target position. Using the control surfaces, container 112 maneuvers load-carrier 118 so that load-carrier 118 will surface near the surface target position. The surface target position may be established by one or more sonar signals transmitted from ship 102. Depending on a number of load-carriers 118-126 in operation, a desirable load-carrier separation may be specified to avoid collision and to increase efficiency of the mining operation.

Also during ascent, underwater-balloon 116 determines whether load-carrier 118 has reached surface 104. Once at surface 104, load-carrier 118 becomes load-carrier 126 and underwater-balloon 116 transmits a surface-tracking signal 136 in the air. If required by conditions at surface 104, underwater-balloon 116 may turn on lights that mark a water surface position. After the surface-tracking signal 136 is received by ship 102, for example, ROV 134 may be maneuvered to tow load-carrier 126 into position relative to ship 102 in preparation for hoisting container 112 onto platform 114 and unloading nodules 110.

After load-carrier 126 is towed into position relative to ship 102, hoist line 113 may be lowered from ship 102 into ocean 106, and ROV 134 may attach container 112 to hoist line 113, and detach container 112 from underwater-balloon 116. After detachment from underwater-balloon 116, container 112 is hoisted onto platform 114 for processing. For example, mined nodules 110 may be unloaded from container 112 and salt 302 is loaded as ballast into the now substantially empty container 112. Other maintenance tasks may be performed while container 112 is on platform 114 such as charging or changing a battery that powers the container 112, cleaning a structure of container 112, etc.

After detachment, underwater-balloon 116 may be allowed to float freely or towed elsewhere to allow other load-carriers 126 to be processed. For example, underwater-balloon may be towed to a specified position and attached to a tether line secured by buoys or by a support ship. Underwater-balloon 116 may turn off the tracking signal as commanded by an operator or turned off automatically between when ROV 134 begins towing load-carrier 126 and when container 112 is detached. The tracking signal may be turned on again when underwater-balloon 116 is in a distress circumstance, for example.

Ship 102 may periodically transmit a ping signal and all surfaced underwater-balloons 116 may respond by transmitting an acknowledge signal that may include an identification, location coordinates obtained from an onboard global positioning system (GPS) receiver and/or other status information of the underwater-balloon 116. If underwater-balloon 116 does not receive a ping signal after a predetermined time, then the tracking signal may be automatically turned on as a distress signal, for example. The tracking signal may include messages indicating a reason for its transmission. For example, in addition to surfacing with a load of nodules 110 and not receiving a ping signal, underwater-balloon 116 may indicate possible collision conditions when proximity to other objects is less than a threshold distance, sustained damage such as loss of buoyancy, low battery charge, etc.

Figure 4:
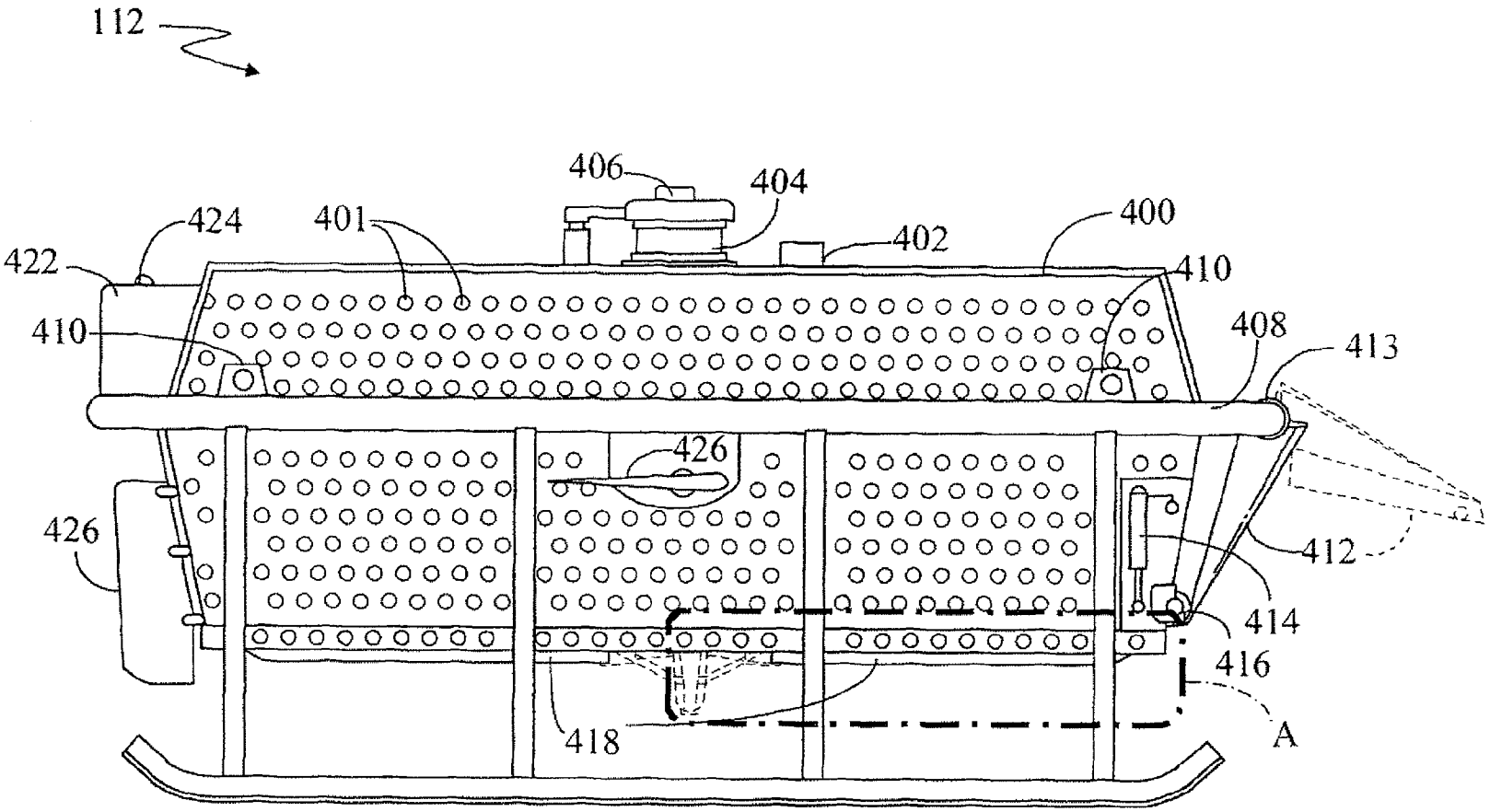
FIG. 4 shows an exemplary detailed diagram of the container.

FIG. 4 shows an example of container 112 in greater detail. For the most part, container 112 may be made of aluminum and/or steel components with appropriate corrosion control coatings for ocean applications. Container 112 includes a hopper 400, a frame 408 onto which hopper 400 is attached, control surfaces 426 attached to frame 408 and/or hopper 400, and controller 422 that controls control surfaces 426. Container 112 may also include a battery to power electrical elements for operation such as controller 422 and any sensors and detectors at least while disconnected from a power source. Frame 408 includes one or more feet 420 that supports load-carrier 120 when landed on bottom 108 of ocean 106. Controller 422 conducts underwater communication using one or more hydrophones 424 such as transmitting tracking signal 122, for example.

Hopper 400 may be constructed of perforated metal having openings such as holes 401 to permit ocean water to flow freely so that as container 112 ascends or descends, water enter and leave container 112 to avoid water intermixing from different levels of ocean 106. Perforations may be only on a top and sides of hopper 400, or instead of perforations, an entry, an exit, and a pump are provided to circulate the ocean water in and out of hopper 400.

Sides of hopper 400 may be slanted to facilitate loading and unloading of nodules 110 and salt 302. For example, sides of a top portion of hopper 400 are slanted outwards so that as nodules 110 or salt 302 are loaded, space inside hopper 400 expands to avoid clogging. Sides of a bottom portion are slanted inwards to help funnel nodules 110 and/or salt 302 toward ejectors as later discussed.

Connectors 402 and 404 may be mounted on a top and/or side surfaces of hopper 400. Connector 402 may include connections for second and/or third umbilical cords 130 for providing power and a communication link to container 112 during mining at bottom 108. Connector 404 may be connected to loading hose 300 for loading salt 302 when on platform 114 or connected to first umbilical cord 130 for loading nodules 110 during mining. Connector 404 is provided with a cap 406 that may be swung aside when connected to loading hose 300 or first umbilical cord 130, and swung in a capped position when not so connected. Cap 406 prevents nodules 110 and/or salt 302 from escaping while container 112 is ascending or descending through ocean 106.

Hopper 400 includes a hatch 412 shown in a closed position (solid lines) and open position (dashed lines). Hatch 412 is rotatably mounted onto frame 408 at joint 413 which allows hatch 412 to swing between the open and the closed positions. Hatch 412 may be locked in a closed position by lock mechanism 416 to keep hatch 412 closed when not engaged in an unloading operation on platform 114 of ship 102. Lock mechanism 416 is released by a release mechanism 414 such as a solenoid or a hydraulic arm for the unloading operation.

Figure 5:
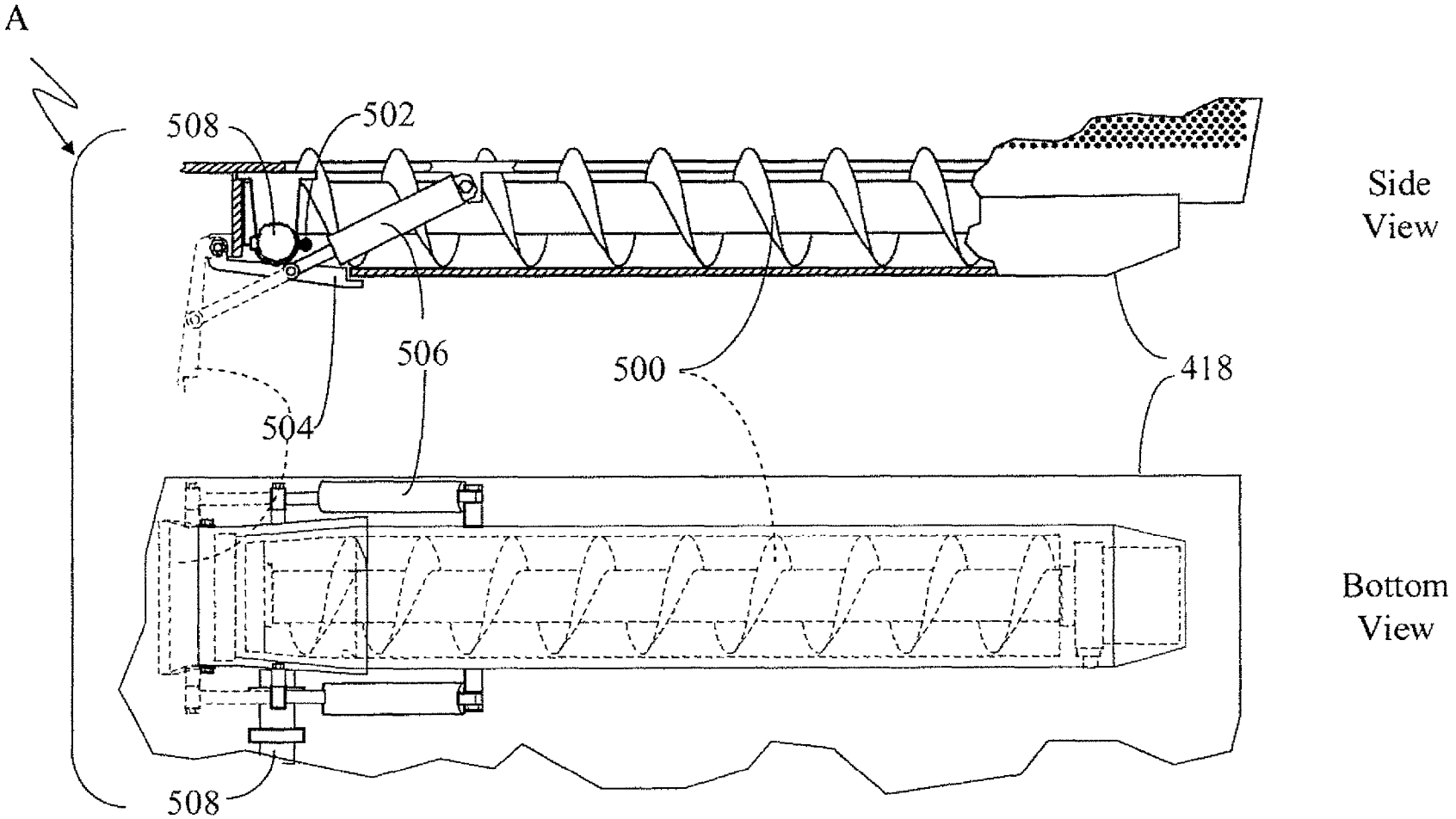
FIG. 5 shows an exemplary diagram of a screw of the container.

A bottom side 418 of hopper 400 houses one or more ejector screws that ejects nodules 110 and/or salt 302 during mining. FIG. 5 shows detailed side and bottom views of a screw 500 that is disposed in a cavity of bottom side 418 located at portion A of FIG. 4. An opening 502 is located at one end of screw 500 where nodules 110 and/or salt 302 may be ejected. A door 504 may be actuated by an actuating mechanism 506 to close opening 502 to prevent nodules 110 and/or salt 302 from escaping. Actuating mechanism 506 may be a hydraulic arm or a solenoid, for example.

To facilitate ejecting salt 302, it is preferable for salt 302 to have an approximately round shape having a diameter approximately matching that of nodules 110. In this way, screw 500 may be designed to eject nodules 110 and/or salt 302. For example, nodules 110 may have an average diameter of about 5 centimeters (cm). Correspondingly, salt 302 may be formed into the approximately round shape having a diameter of about 5 cm.

Other types of ejectors may be used such as an impeller arranged in a round hole of bottom 418. Or, the ejector may be disposed in a rectangular cylindrical hole arranged at bottom 418 much like a laundry chute and a paddle structure disposed at one of the sides turns to eject nodules 110 and/or salt 302 through an opening from hopper 400. Salt ejection is stopped when the paddle stops turning and blocks the opening like a closed door.

Although it is desired for salt 302 to be dissolved into the water of ocean 106, it is not desirable for salt 302 to undergo dissolution while still in hopper 400 because salt 302 may fuse into a solid block making it difficult to eject. Thus, it is preferable for salt 302 to be coated with a coating material to reduce a dissolution rate. Additionally, it would be desirable for the coating material to have lubrication properties so that salt 302 may not be jammed in hopper 400 and prevented from reaching screw 500. For example, salt 302 may be coated with an agent such as a thin layer of Magnesium Carbonate ($MgCO_3$). Also, uncoated salt 302 may clog screw 500 and prevent screw 500 from turning to eject nodules 110 and/or salt 302. If a clogging condition occurs, controller 422 may reverse turning direction of screw 500 as an unclogging action. However, coating salt 302 with a lubricating material may avoid such undesirable circumstances altogether.

An ejector may be equipped with a nodule 110/salt 302 detector 508. Detector 508 may be disposed at an output end of the ejector to determine whether nodules 110 and/or salt 302 are being ejected. For example, FIG. 5 shows detector 508 disposed in close proximity to opening 502. Detector 508 may include an illuminator and a detector. The illuminator may be one or more light emitting diodes such as laser diodes that emit a light wavelength selected to distinguish between nodules 110 and salt 302. For example, a light wavelength may be selected that is absorbed by nodules 110, but reflected by salt 302 (or a coating of salt 302) or vice-versa. If tailings are used as ballast, coating the tailings with a lubrication material that also serves to distinguish tailing from nodules 110 would be advantageous. In this way, a light detector having a sensitivity range that encompasses the selected light wavelength may be used to distinguish whether nodules 110 or salt 302 are being ejected.

As shown in FIG. 5, detector 508 may be positioned so that light from the illuminator is directed into opening 502 where nodules 110 and/or salt 302 exit. Light reflected from nodules 110 and/or salt 302 are detected by a light detector such as a camera, for example. The camera may be selected to be especially sensitive to the selected wavelength so that an operator may distinguish between nodules 110 and salt 302. The camera may be disposed along a same axis as the illuminator so that no alignment between the illuminator and the camera is required. For example, a plurality of light emitting diodes may be disposed around a camera lens in a circular fashion.

Figure 6:
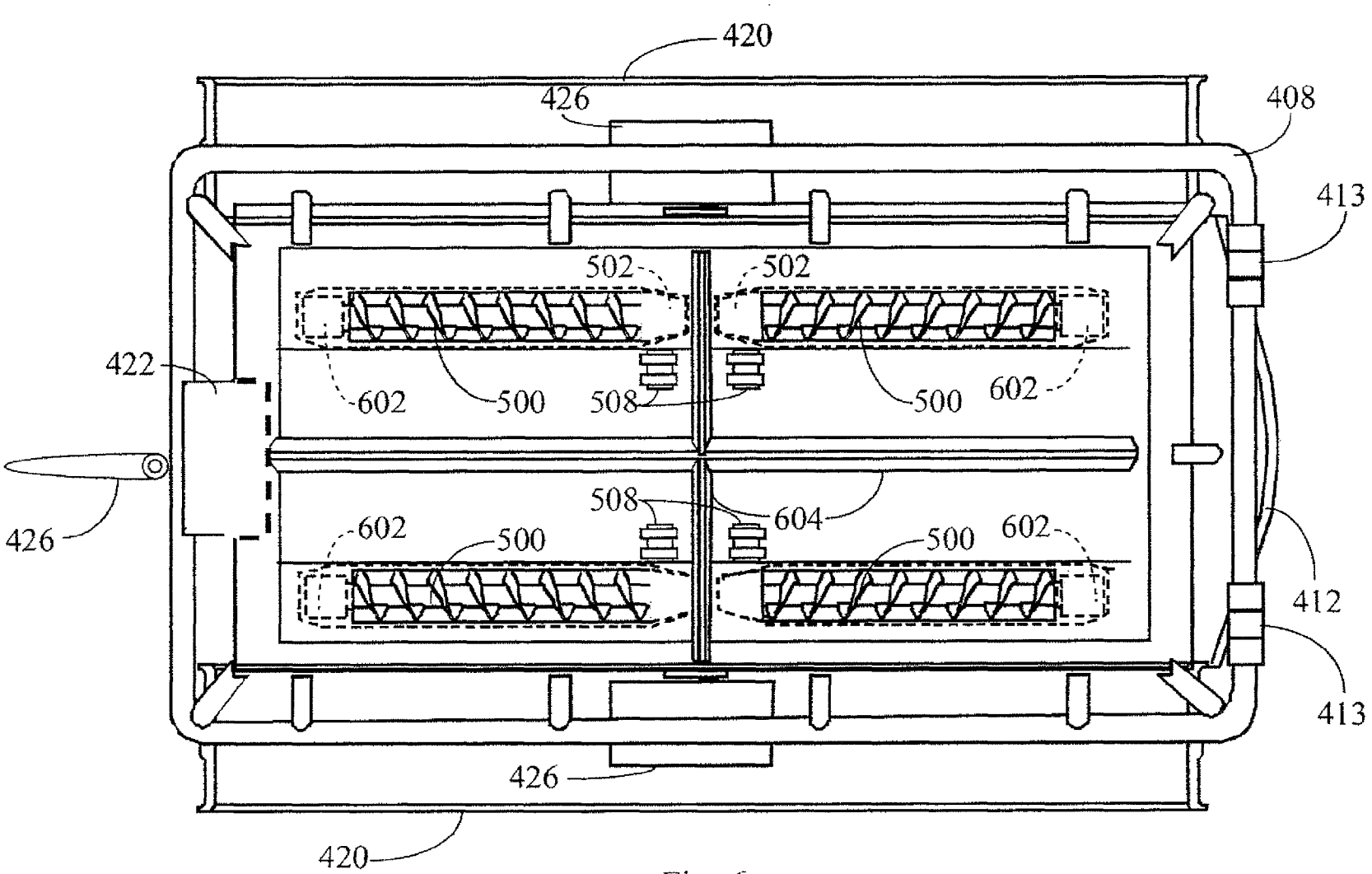
FIG. 6 shows an exemplary diagram of a bottom side of the container showing positions of 4 screws.

FIG. 6 shows an example of a bottom view of hopper 400 that includes a specific embodiment of 4 screws 500 disposed in 4 cavities of bottom 418 of hopper 400. Openings 502 of screws 500 are disposed toward a center of bottom 418 so that openings 502 of two screws 500 disposed on a same side of hopper 400 face each other. A motor 602 drives each of screws 500. Motors 602 may be hydraulic or electric motors. Hydraulic or electric motors may be obtained from companies such as Sub-Atlantic (Sub-Atlantic Inc.: 10642 West Little York, Suite 100, Houston, Tex. 77041-4014-USA; sales@sub-atlantic.com; T: +1 713 329 8730). This arrangement forces nodules 110 and/or salt 302 to be ejected toward a center of bottom 418. Detectors 508 are shown to be disposed near opening 502 of each screw 500. The emitted light and the cameras are both pointing into respective openings 502.

Figure 7:
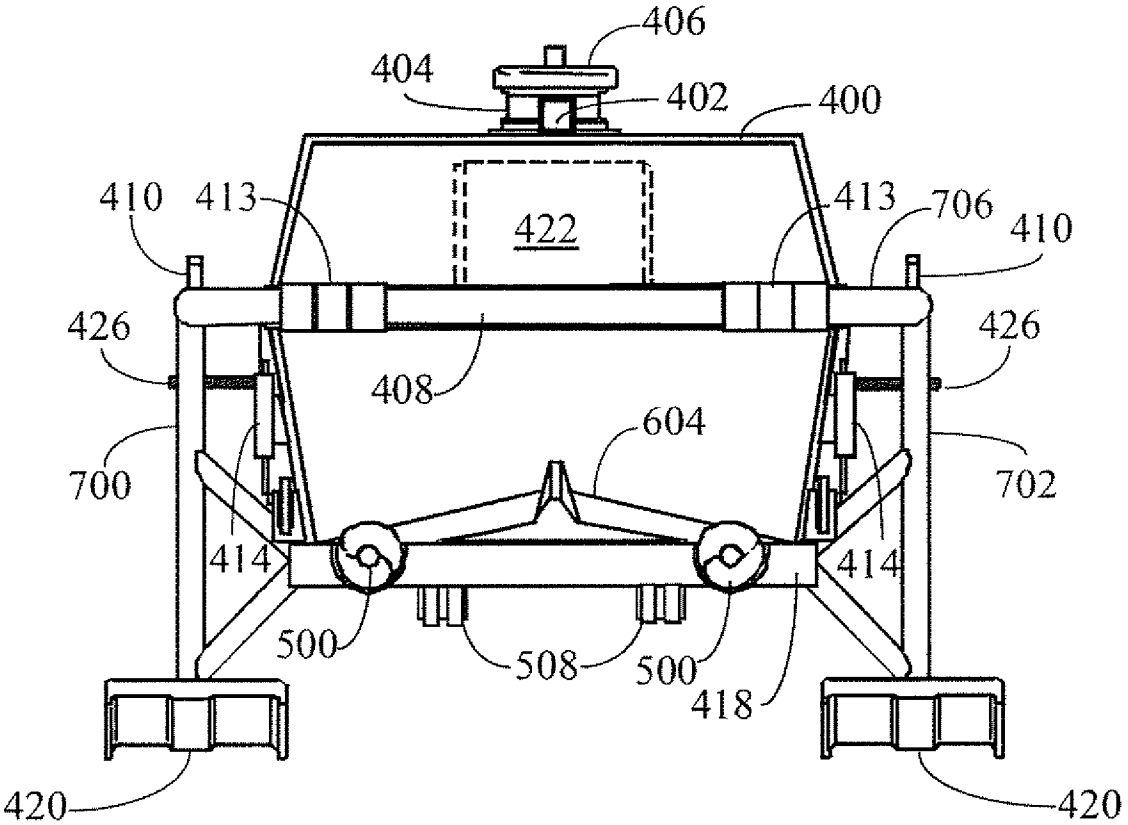
FIG. 7 shows an exemplary diagram from a front side of the container.

A funnel structure 604 is disposed on an inside surface of bottom 418 that directs nodules 110 and/or salt 302 toward screws 500. FIG. 7 shows funnel structure 604 being raised near a center of bottom 418 and slopping downward toward bottom 418 from the center of bottom 418 to sides of hopper 400. As salt 302 and/or nodules 110 are being ejected, other salt 302 and/or nodules 110 further inside hopper 400 are urged toward screws 500 for further ejection.

Controller 422 of container 112 may independently control each of screws 500. Sensors are provided on container 112 that detect a position of hopper 400. Salt 302 and/or nodules 110 are ejected by screws 500 to maintain hopper 400 in a desired position such as having bottom 418 of container 112 parallel to a horizontal level plane. If hopper 400 is more loaded on one side, an unbalanced situation is created. When such a condition is detected, controller 422 may eject more salt 302 from the more heavily loaded side to reduce the unbalance.

Also, when hopper 400 is nearly full of nodules 110, an operator may observe through detectors 508 which of the screws 500 is ejecting salt 302 and which is ejecting nodules 110. Screws 500 that are not ejecting salt 302 may be stopped while the ones that are ejecting salt 302 may continue ejection so that more of the load in hopper 400 may be nodules 110 instead of salt 302.

FIG. 7 shows a front view of container 112 with hatch 412 removed. An exemplary frame 408 is shown having a top portion 706, side portions 700 and 702, and feet 420. Hopper 400 is supported by frame 408 and disposed between side portions 700 and 702. Container 112 may be about 4.2 meters high, about 5.3 meters wide between side portions 700 and 702, and about 8.5 meters long between front (where hatch 412 is disposed) and back (where controller 422 is disposed). Bottom 418 of hopper 400 is disposed about one meter above bottom of feet 420 so that when supported by feet 420, there is enough room between ocean bottom 108 and hopper bottom 418 for salt 302 to be ejected without being jammed between bottoms 108 and 418.

Frame 408 also include attachment portions 410 that provides a ridged structure having sufficient strength for lifting a fully loaded hopper 400 onto platform 114 of ship 102. FIG. 4 shows attachment portions 410 to be tabs attached to top portion 706 of frame 408. Cables may be threaded through the holes and ends of the cables may be attached to a detachable link for attaching and detaching container 112 from underwater-balloon 116 or hoist line 113 of ship 102.

Feet 420 are shaped to have enough area to support landing of load-carrier 118 at bottom 108 and grasp ocean bottom 108 to secure load-carrier 120 in the landing site against possible water currents while waiting for ROV 132 and mining-vehicle 128. At the same time, the shape of feet 420 allows release of bottom 108 by appropriate change of buoyancy of load-carrier 120 to begin mining operation as load-carrier 124.

Figure 8:
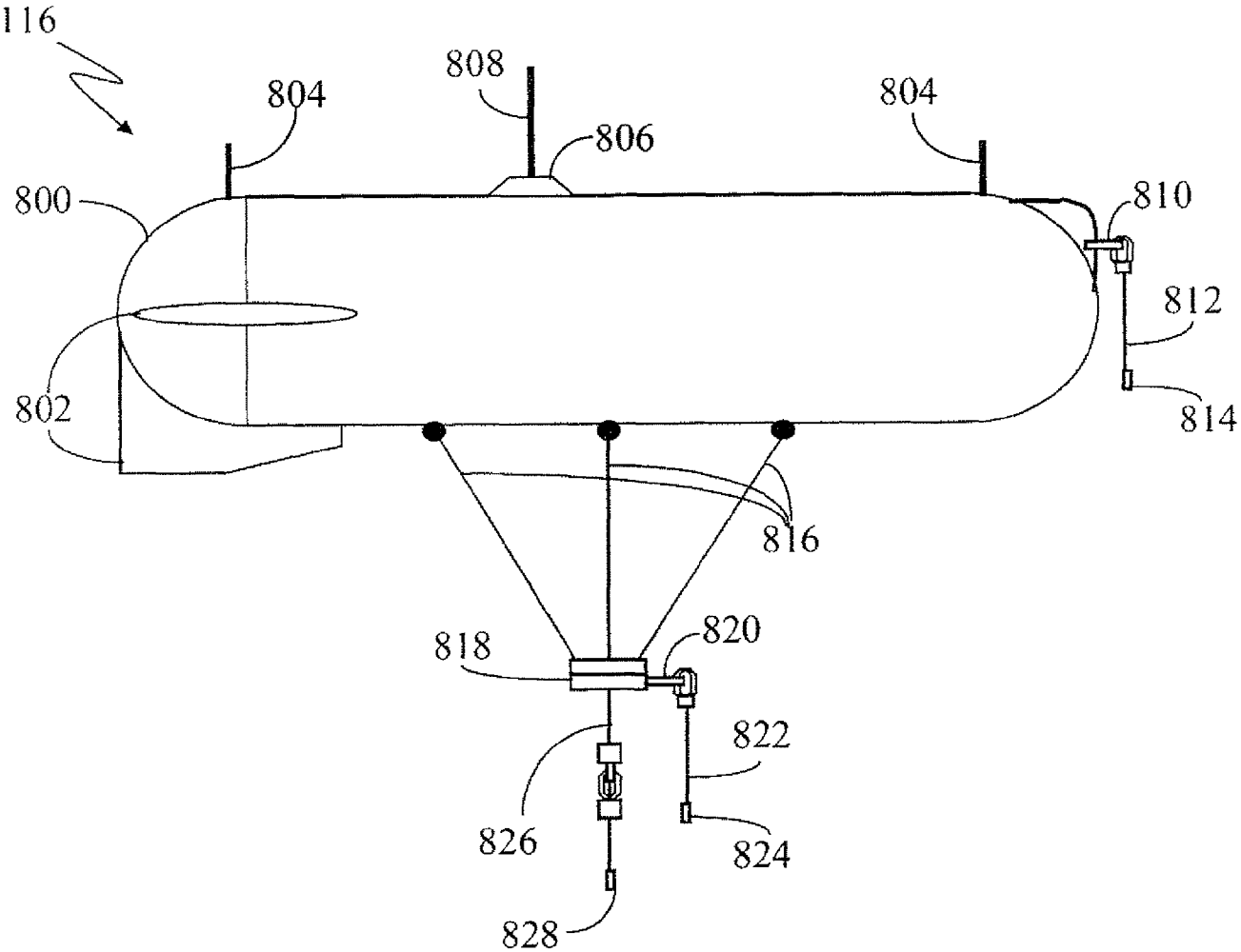
FIG. 8 shows an exemplary diagram of an underwater-balloon.

FIG. 8 shows an example of underwater-balloon 116 having a main body 800, fin structures 802 formed on a back end of main body 800, lights 804, a controller 806, an antenna 808, a hitch 810 attached to a front end of main body 800, a cable 812, an attachment 814, lifting cables 816 attached between main body 800 and a rotatable bearing 818. A battery may also be included to power lights 804 and controller 806. A solar panel packaged to withstand deep water pressures may be mounted on a top side of main body 800 to charge the battery when sun light is available. Main body 800 may be about 13 meters long between the front and the back ends, about 5 meters high and about 5 meters wide (not including fins 802).

Figure 9:
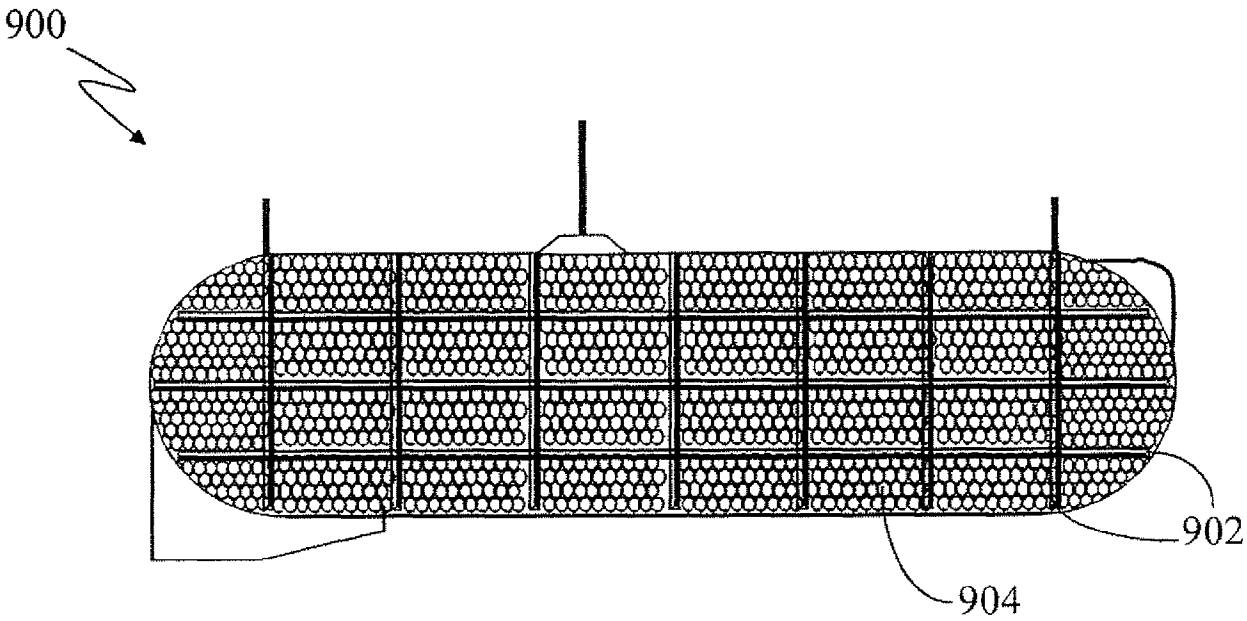
FIG. 9 shows an exemplary diagram of the underwater-balloon with an external covering removed.

Attached to rotatable bearing 818 are a hitch 820, a cable 822, an attachment 824, a container-lift cable 826, and an attachment 828. Main body 800 may be filled with buoyant objects that can withstand deep-water pressures such as at ocean bottom 108. For example, FIG. 9 shows main body 800 having glass and/or ceramic balls 904 with a substantially vacuum interior mounted on racks 902. Deep-sea glass balls may be obtained from Teledyne Benthos (benthos@teledyne.com; 49 Edgerton Drive, North Falmouth, Mass. 02556 USA; Tel 508-563-1000) such as models 2040-10V, -13V and -17V, or from McLane Research Laboratories (www.mclanelabs.com; Falmouth Technology Park; Tel: 508.495.4000) models G2200, G6600, or G8800, for example. Ceramic balls such as various models of Seaspheres may be obtained from Deepsea Power & Light (www.deepsea.com; 4033 Ruffin Road, San Diego, Calif. 92123; ph: (858) 576-1261)), for example.

Main body 800 is covered with a covering material that is light but tough to withstand underwater mining conditions. The covering material may be ultra-high-molecular-weight polyethylene fibers, Spectra® fibers, and/or polyester fabrics, for example. Additionally, coating materials for a base fabric may be used such as polyurethane, polyethylene, and/or vinylesters to provide some UV resistance and snag protection. The covering material forms a shape that is advantageous to negotiate water currents. For example, on descent, when a water current is encountered broadside, forces exerted on the back end having fins 802 are greater than the forces on a front end. Thus, main body 800 will rotate into a position to face the water current with a relatively smaller profile of the front end so as to better avoid being taken off course and drift far away from the target position at bottom 108. The same may occur on ascent so that load-carrier 118 may surface at a location close to a surface target location. Fins 802 have both horizontal and vertical planes. This enables position adjustments for water currents having both horizontal and vertical vector components.

Hitch 810, cable 812 and attachment 814 provide for towing underwater-balloon 116 on surface 104. In some circumstances, underwater-balloon 116 or load-carrier 126 needs to be placed in a specific location relative to ship 102 or a tether line. A towing boat on surface 104 may attach to underwater-balloon 116 via hitch 810, cable 812 and attachment 814 at the front end to perform the towing task. The same task may be performed underwater by ROV 134, for example, using hitch 820, cable 822 and attachment 824.

Rotatable bearing 818 permits main body 800 to rotate relative to container 112. As discussed above, main body 800 is responsive to water currents and rotates so that the front end of main body 800 is made to face the water currents. However, container 112 may be loaded with either salt 302 and/or nodules 110 and may have significant mass introducing a rotational resistance that impedes an ability of main body 800 to rotationally adjust its position. Rotatable bearing 818 relieves this rotational resistance and thus allows main body 800 to rotate more freely relative to container 112.

Rotatable bearing 818 also provides advantageous under water towing of load-carrier 126 by ROV 134. Hitch 820 is attached to a lower portion of rotatable bearing 818 which in turn is attached to container 112. As indicated above, underwater-balloon 116 has a shape that generates a rotational force to face water currents with the front end. ROV 134 generates a water current when towing load-carrier 126. Thus, rotatable bearing 818 permits underwater-balloon 116 to point the front end in the towing direction and reduce a dragging force against ROV 134 while towing load-carrier 126.

Attachment 828 at an end of container-lift cable 826 may also include a communication connector that connects controller 806 of underwater-balloon 116 with controller 422 of container 112 through a communication cable threaded between controllers 422 and 806. During various stages of the mining process, one or the other of controllers 422 and 806 is in communication with an operator and relevant commands or data from the other one of the controllers 422 and 806 may be relayed between the controllers 422 and 806. For example, when engaged in a mining operation at bottom 108, controller 422 is in communication with operator through umbilical cords 130 while controller 806 cannot communicate with the operator. Thus, a communication connection between controller 422 and 806 through a communication connector in attachment 828 enables controller 806 to receive an ascend command, for example.

On surface 104, controller 806 may be in wireless communication with an operator and can relay information to and from controller 422. For example, while load-carrier 126 is being towed into position for hoisting container 112 to platform 114, an operator can receive status of container 112 such as status of screws 500 or battery charge condition, for example. Also, antenna 808 may be made accessible to controller 422 so that controller 422 may communicate wirelessly through air to an operator. In this way, a crew on ship 102 may he prepared to process container 112 appropriately when container 112 is on platform 114.

Figure 10:
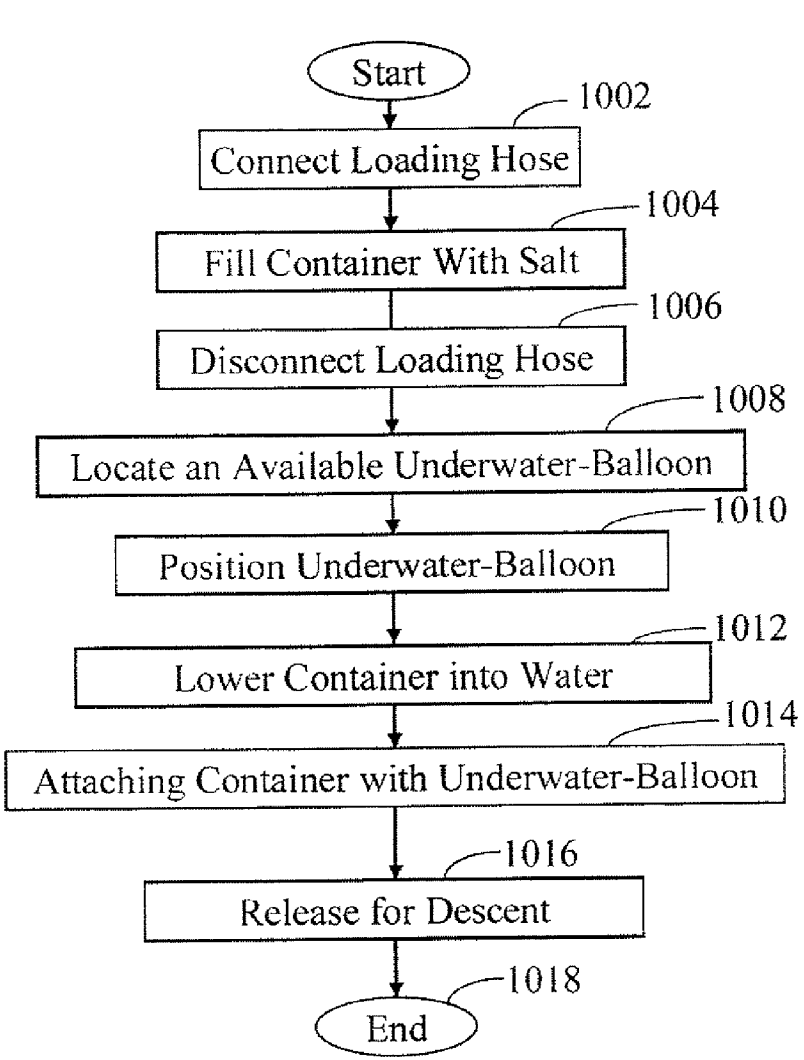
FIG. 10 shows an exemplary flow-chart of preparing a load-carrier for descent into the ocean.

FIG. 10 shows a flowchart 1000 of an exemplary process that prepares container 112 for descend to bottom 108. In step 1002, cap 406 is swung aside and loading hose 300 is connected to connector 404, and the process goes to step 1004. In step 1004, salt 302 is loaded into hopper 400, and the process goes to step 1006. As discuss earlier, salt 302 is substantially solid and has an approximately round shape having a diameter approximately that of nodules 110 which may be about 5 cm. Salt 302 is coated with a material that retards dissolution into ocean water and assist in lubricating salt 302 to help prevent jams or clogging.

In step 1006, loading hose 300 is disconnected and the process goes to step 1008. In step 1008, the process locates an available underwater-balloon 116, and goes to step 1010. As discussed earlier, underwater-balloons 116 that are not attached to a container 112 may be floating freely on surface 104 or attached to tether lines. Ship 102 may send periodic ping signals to manage underwater-balloons 116. Thus, when container 112 is being processed on platform 114, an underwater-balloon 116 may be identified and towed into position near ship 102 in preparation for attaching to container 112 for descent to bottom 108.

In step 1010, the process positions the located underwater-balloon 116, and goes to step 1012. In step 1012, container 112 that is loaded with salt 302 is lowered into water of ocean 106 using hoist line 113 and made ready for attachment to a positioned underwater-balloon 116, and the process goes to step 1014. In step 1014, ROV 134 attaches container 112 to attachment 828 of underwater-balloon 116, and the process goes to step 1016. In step 1016, ROV 134 detaches hoist line 113 from container 112, thus forming load-carrier 118 that proceeds to descend to bottom 108, and the process goes to step 1018 and ends.

Figure 11:
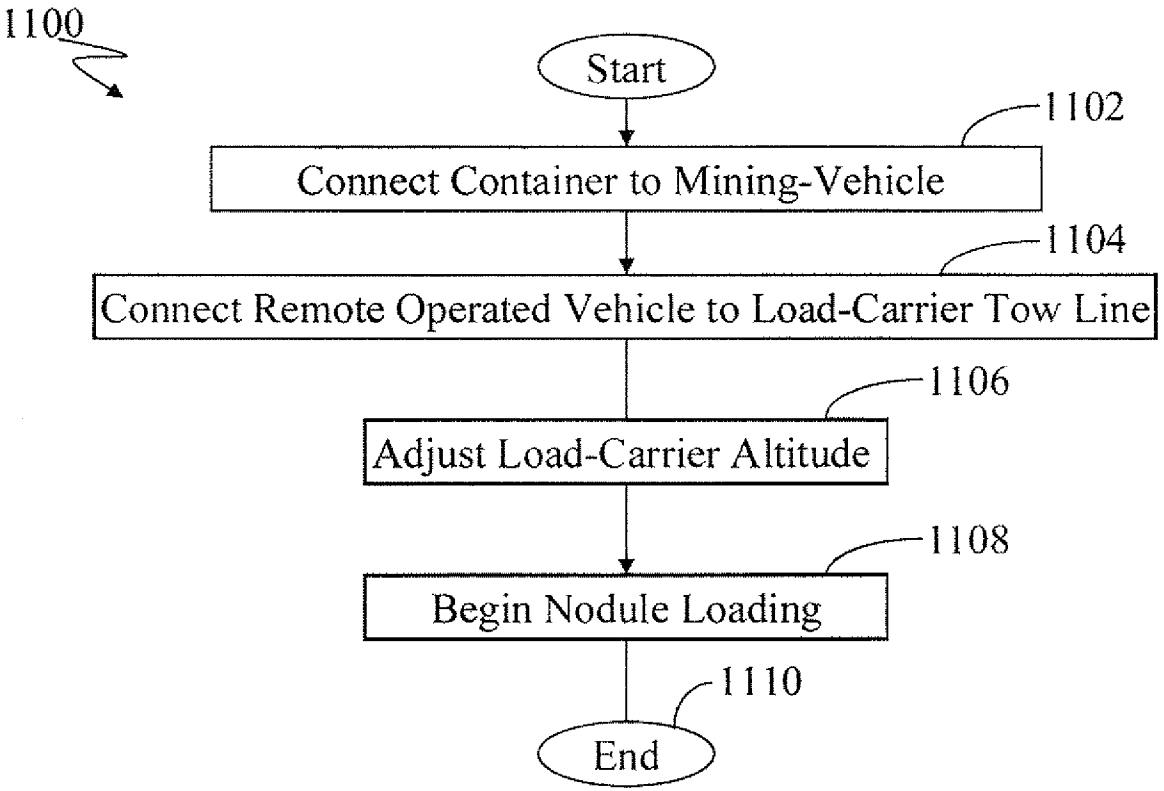
FIG. 11 shows an exemplary flow-chart of preparing the load-carrier for loading nodules from a mining-vehicle.

As discussed above, load-carrier 118 descends to bottom 108, becomes load-carrier 120 and begins to transmit a tracking signal. When located, load-carrier 120 is converted to load-carrier 124 by an exemplary process shown in FIG. 11 shown as a flowchart 1100. In step 1102, ROV 132 connects container 112 to mining-vehicle 128 via umbilical cords 130, and goes to step 1104. As noted earlier, umbilical cords 130 may be separate multiple cords, a single cord, or multiple cords bound together into a single cord. Umbilical cords 130 enable mining-vehicle 128 to load mined nodules 110 into hopper 400 of container 112, provide power to container 112 and provide a communication link to controller 422 and possibly to controller 806 of underwater-balloon 116.

In step 1104, ROV 132 attaches to attachment 824 and prepares to tow load-carrier 124 to follow mining-vehicle 128, and the process goes to step 1106. In step 1106, container 112 ejects ballast to lift load-carrier 124 above bottom 108 to a specified altitude (about an average of 50 meters as discussed below), and the process goes to step 1108. In step 1108, mining-vehicle begins loading nodules 110 into hopper 400, and the process goes to step 1110 and ends.

Figure 12:
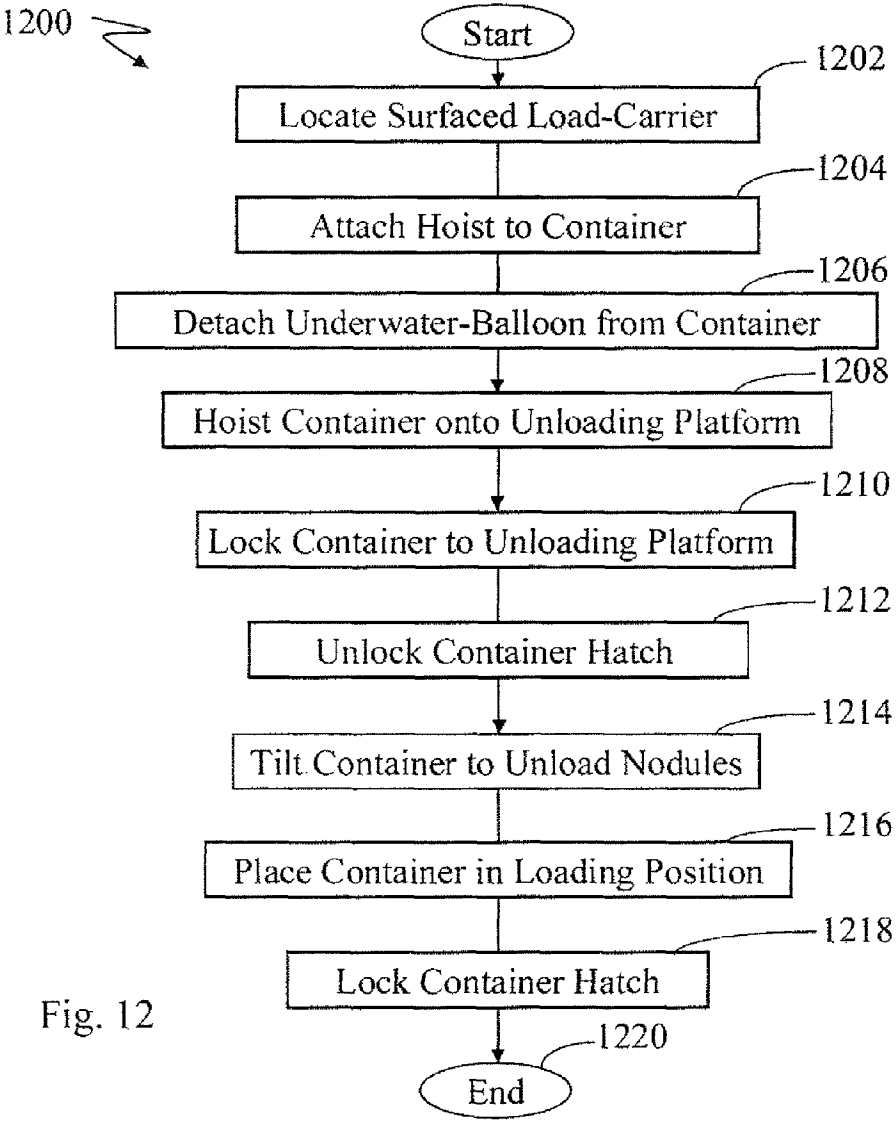
FIG. 12 shows an exemplary flow-chart for processing a surfaced load-carrier.

After hopper 400 is loaded with nodules 110, load-carrier 124 is converted to load-carrier 118 for ascending to surface 104. After ascending to surface 104, load-carrier 118 becomes load-carrier 126 and is towed into position near ship 102 for unloading by an exemplary process shown in a flowchart 1200 of FIG. 12. In step 1202, load-carrier 126 is located based on the tracking signal transmitted by controller 806 via antenna 808, and towed into position for container 112 to be hoisted onto platform 114, and the process goes to step 1204. In step 1204, hoist line 113 is lowered into the water, and ROV 134 attaches hoist line 113 to container 112, and the process goes to step 1206. In step 1206, ROV 134 detaches underwater-balloon 116 from container 112, and the process goes to step 1208.

In step 1208, container 112 is hoisted onto platform 114, and the process goes to step 1210. In step 1210, container 112 is locked to platform 114 to prevent container 112 from moving while being processed, and the process goes to step 1212. In step 1212, hatch 412 is unlocked by activating release mechanism 414, and the process goes to step 1214. In step 1214, platform 114 is tilted to unload nodules 110 into a cargo hold of ship 102, and the process goes to step 1216. In step 1216, container 112 is returned to a loading position by lowering platform 114, and the process goes to step 1218. In step 1218, hatch 412 is locked by locking mechanism 416, and the process goes to step 1220 and ends.

Figure 13:
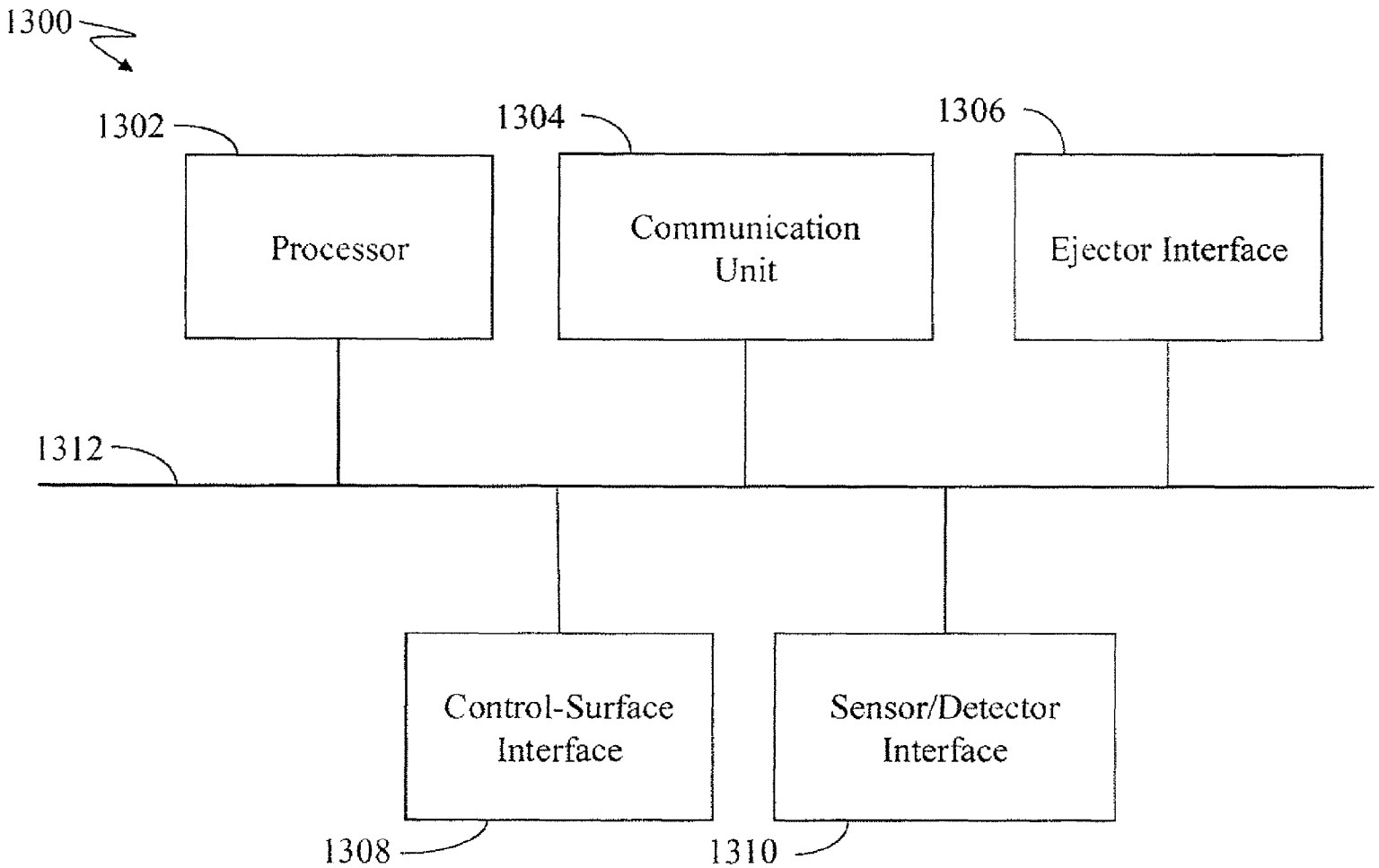
FIG. 13 shows an exemplary block diagram of a container-controller.

FIG. 13 shows an exemplary block diagram of controller 422 that is mounted on container 112. Controller 422 includes a processor 1302, a communication unit 1304, an ejector interface 1306, a control-surface interface 1308, and a sensor/detector interface 1310. All of these components 1302-1310 are connected together via bus 1312. Although a bus architecture is shown as an example, other component interconnections may be used as is well known. For example, a parallel connection between components may be used where high bandwidth may be required or where tight timing requirements are present. However, for low bandwidth and/or loose timing situations, serial connections may be used. Controller 422 may be implemented using various technologies such as PLAs, PALs, applications specific integrated circuits (ASICs), off the shelf processors, and/or software executed in one or more general purpose or special purpose processors using one or more CPUs, for example. Memory that is included in any component 1302-1310 may be implemented using hard disk, optical disk, and/or RAM/ROM in either volatile or nonvolatile technologies.

Controller 422 may actively control a position of load-carrier 118 by using control surfaces 426 and/or by adjusting buoyancy of load-carrier 124 (during mining). On descent, communication unit 1304 may receive from hydrophones 424 the homing sonar signal transmitted from a desired target position on bottom 108. Processor 1302 receives the target position information from communication unit 1304 and determines adjustments to control surfaces 426 that is needed to steer load-carrier 118 toward the target position. Processor 1302 issues commands to control-surface interface 1308 based on the determined adjustments to actively control the position of load-carrier 118.

Processor 1302 may also receive from sensor/detector interface 1310 information relating to an orientation of container 112 that may indicate whether one side of container 112 is more heavily weighted than another side. This undesirable condition results in an unbalanced situation where horizontal attitude is not level at true horizontal relative to gravity. Sensors such as micro-electrical-mechanical systems (MEMS) inertial navigation devices (available, for example, from companies such as Atlantic Inertial Systems: Clittaford Road, Southway; Plymouth, Devon; PL6 6DE United Kingdom; www.atlanticinertial.com; Telephone +44 (0) 1752 722103, or from RADA Electronic Industries: www.rada.com; 7 Giborei Israel St., Sapir Indutrial Park; P. O. Box 8606 Zip 42504, Netanya, Israel; Tel: +972-9-892-1111) and/or optical inertial navigation devices may be used to measure attitude, motion and position to detect the unbalanced situation, for example. This unbalanced situation may occur if salt 302 or nodules 110 were not loaded evenly on all sides of container 112. Processor 1302 may arrange control surfaces 426 to help alleviate any undesirable forces placed on attachment portions 410 and associated cables during descent or ascent through ocean 106.

Container 112 may include a bottom detector such as echo sounding device that provides an estimated distance to bottom 108. Processor 1302 receives information from the bottom detector through sensor/detector interface 1310 and determines if load-carrier 118 has reached bottom 108. Once load-carrier 118 has landed on bottom 108, it becomes load-carrier 120 and processor 1302 issues a command to communication unit 1304 to begin transmitting the tracking signal to alert an operator of the landing event and availability for the mining operation to begin.

As discussed in connection with FIG. 11, ROV 132 converts load-carrier 120 to load-carrier 124 by connecting umbilical cords 130 to container 112 and then connects to attachment 824 in preparation to tow load-carrier 124 during mining operation. Once umbilical cords 130 is connected, processor 1302 confirms that umbilical cords 130 are functioning and then waits for receipt of a command from communication unit 1304 to commence a mining procedure.

When the command to commence is received, processor 1302 commands screws 500 through ejector interface 1306 to eject salt 302 from hopper 400. Once salt 302 is ejected, load-carrier 124 begins to rise due a change in buoyancy. Processor 1302 receives information from the bottom detector via sensor/detector interface 1310 to determine whether feet 420 is within a predetermined distance range to bottom 108. For example, feet 420 may be kept at an average altitude of about 50 meters above bottom 108. Considering umbilical cords 130 having a length of about 100 meters, feet 420 may be kept within a range of about ±50 meters from bottom 108 without pulling too hard at umbilical cords 130.

While processor 1302 is ejecting salt 302 to maintain the distance of feet 420 to within the predetermined range, mining-vehicle 128 loads mined nodules 110 into hopper 400 through umbilical cords 130. This loading action tends to weigh load-carrier 124 down resulting in reducing the distance between feet 420 and bottom 108. Thus, processor 1302 must actively monitor the distance between feet 420 and bottom 108 and eject salt 302 accordingly. This process continues until nodules 110 are ejected as detected by detectors 508.

For the 4 screw 500 embodiment, processor 1302 may determine which of the screws 500 ejected nodules 110 based on information received from detectors 508 via sensor/detector interface 1310. Processor 1302 may continue to eject salt 302 from other screws 500 not ejecting nodules 110 until nodules 110 are ejected from all screws 500 before a signal is issued to stop loading further nodules 110. Although some salt 302 may still remain in hopper 400, as much salt 302 as possible is replaced by nodules 110 to increase mining efficiency.

After the signal to stop loading further nodules 110 is issued, processor 1302 waits to receive an ascend command from communication unit 1304. At this time ROV 132 may move into position to disconnect umbilical cords 130. When the ascend command is received, processor 1302 commands screws 500 to further eject nodules 110 to adjust buoyancy of load-carrier 124 for ascending to surface 104 as load-carrier 118.

The ejection complete signal is issued because umbilical cords 130 cannot be disconnected before ejection is completed since screws 500 are powered through umbilical cords 130. Once umbilical cords 130 are disconnected from container 112, no additional nodules 110 can be ejected. Thus, ROV 132 cannot disconnect umbilical cords 130 from container 112 until container 112 transmits the ejection complete signal.

Once sufficient nodules 110 and/or salt 302 have been ejected to increase buoyancy of load-carrier 124 loaded with nodules 110, load-carrier 124 begins to ascend. ROV 132 disconnects umbilical cords 130 as soon as the ejection complete signal is received. Umbilical cords 130 may be disconnected from container 112 before load-carrier 124 rises to a maximum distance allowed by the length of umbilical cords 130. When umbilical cords 130 are disconnected, load-carrier 124 becomes load-carrier 118 while ascending to surface 104.

During ascent, processor 1302 performs corresponding functions as performed on descent. Communication unit 1304 may receive from hydrophones 424 sonar signals transmitted from ship 102 to establish a surface target position. Processor 1302 receives the surface target position information from communication unit 1304 and determines adjustments to control surfaces 426 that is needed to steer load-carrier 118 toward the surface target position. Processor 1302 issues commands to control-surface interface 1308 based on the determined adjustments to actively control the position of load-carrier 118.

As on descent, processor 1302 may also receive from sensor/detector interface 1310 information relating to an orientation of container 112 that may indicate whether one side of container 112 is more heavily weighted than another side that results in an unbalanced situation. This unbalanced situation may occur if nodules 110 were not loaded evenly on all sides of container 112. Processor 1302 may arrange control surfaces 426 to help alleviate any undesirable forces placed on attachment portions 410 and associated cables during ascent through ocean 106.

Container 112 may receive surfacing information from controller 806 of underwater-balloon 116 indicating that load-carrier 118 has surfaced. Alternatively, a surface detector that may be included in container 112 that generates the surfacing information. Processor 1302 receives the surfacing information and prepares for being hoisted onto platform 114 of ship 102. For example, if processor 1302 is connected to controller 806, status information, logs, battery condition, etc., for container 112 may be transmitted through controller 806 to an operator in preparation for processing container 112 while on platform 114.

Figure 14:
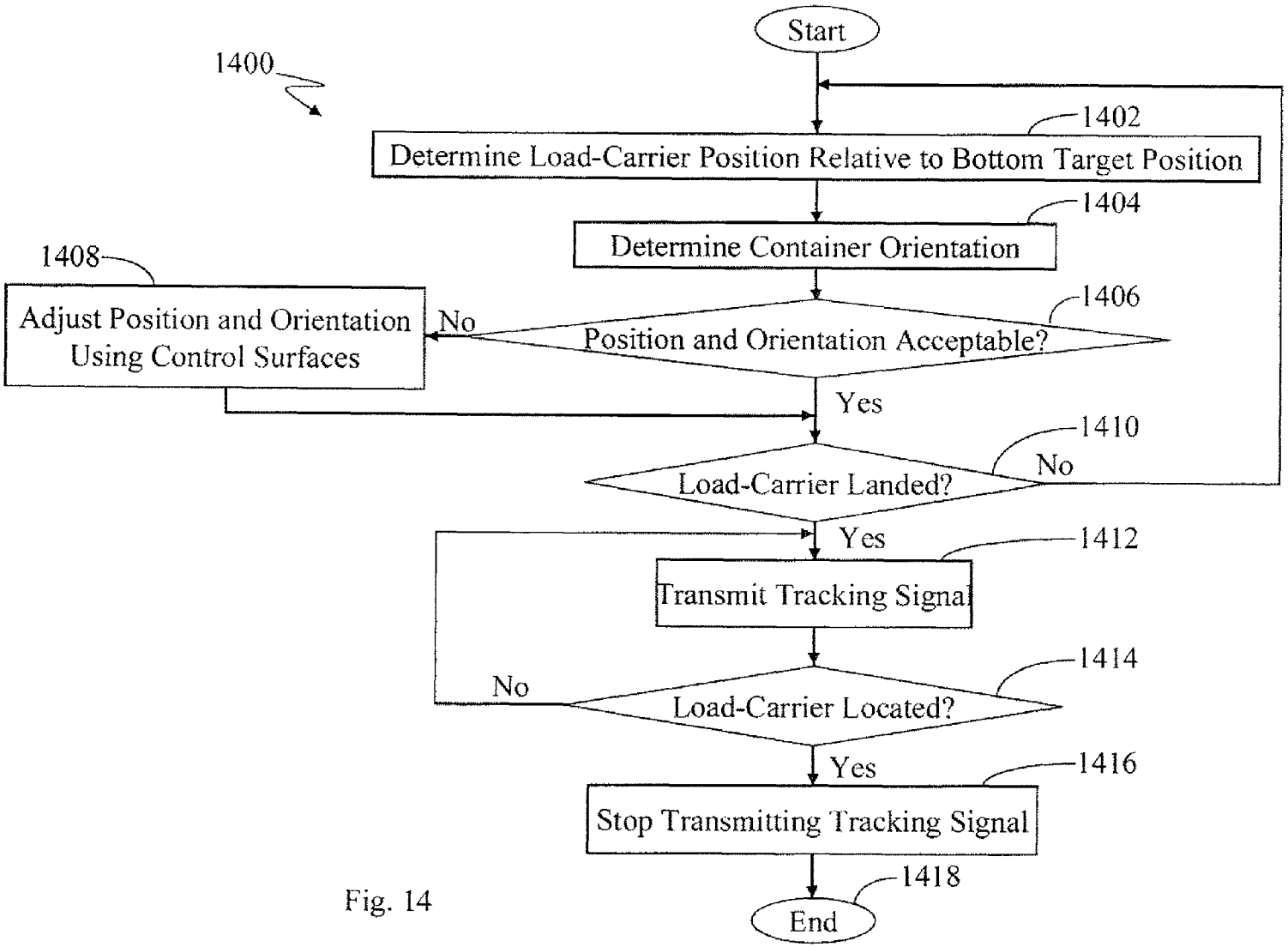
FIG. 14 shows exemplary flow-chart of the container-controller for controlling the load-carrier during descent to the ocean bottom.

FIG. 14 shows a flowchart 1400 of an exemplary process of processor 1302 during descent. In step 1402, processor 1302 determines a position of load-carrier 118 relative to a target position at bottom 108, and the process goes to step 1404. In step 1404, processor 1302 determines an orientation of container 112 based on data received through sensor/detector interface 1310, and the process goes to step 1406. In step 1406, processor 1302 determines whether position of load-carrier 118 and orientation of container 112 are within an acceptable range. If the position of load-carrier 118 and orientation of container 112 are acceptable, the process goes to step 1410. Otherwise, if the position and orientation are not acceptable, the process goes to step 1408. In step 1408, processor 1302 commands control surfaces 426 through control-surface interface 1308 to make appropriate adjustments, and the process goes to step 1410.

In step 1410, processor 1302 determines whether load-carrier 118 has landed at bottom 108. If load-carrier 118 has landed, the process goes to step 1412. Otherwise, if load-carrier 118 has not landed, the process returns to step 1402. In step 1412, processor 1302 commands communication unit 1304 to transmit a tracking signal, load-carrier 118 becomes load-carrier 120, and the process goes to step 1414. In step 1414, processor 1302 determines whether load-carrier 120 has been located. This information may be communicated by ROV 132 using a sonar signal, for example. If load-carrier 120 has been located, the process goes to step 1416. Otherwise, if load-carrier 120 has not been located, the process returns to step 1412. In step 1416, processor 1302 commands communication unit 1304 to stop transmitting the tracking signal, goes to step 1418 and ends.

Figure 15:
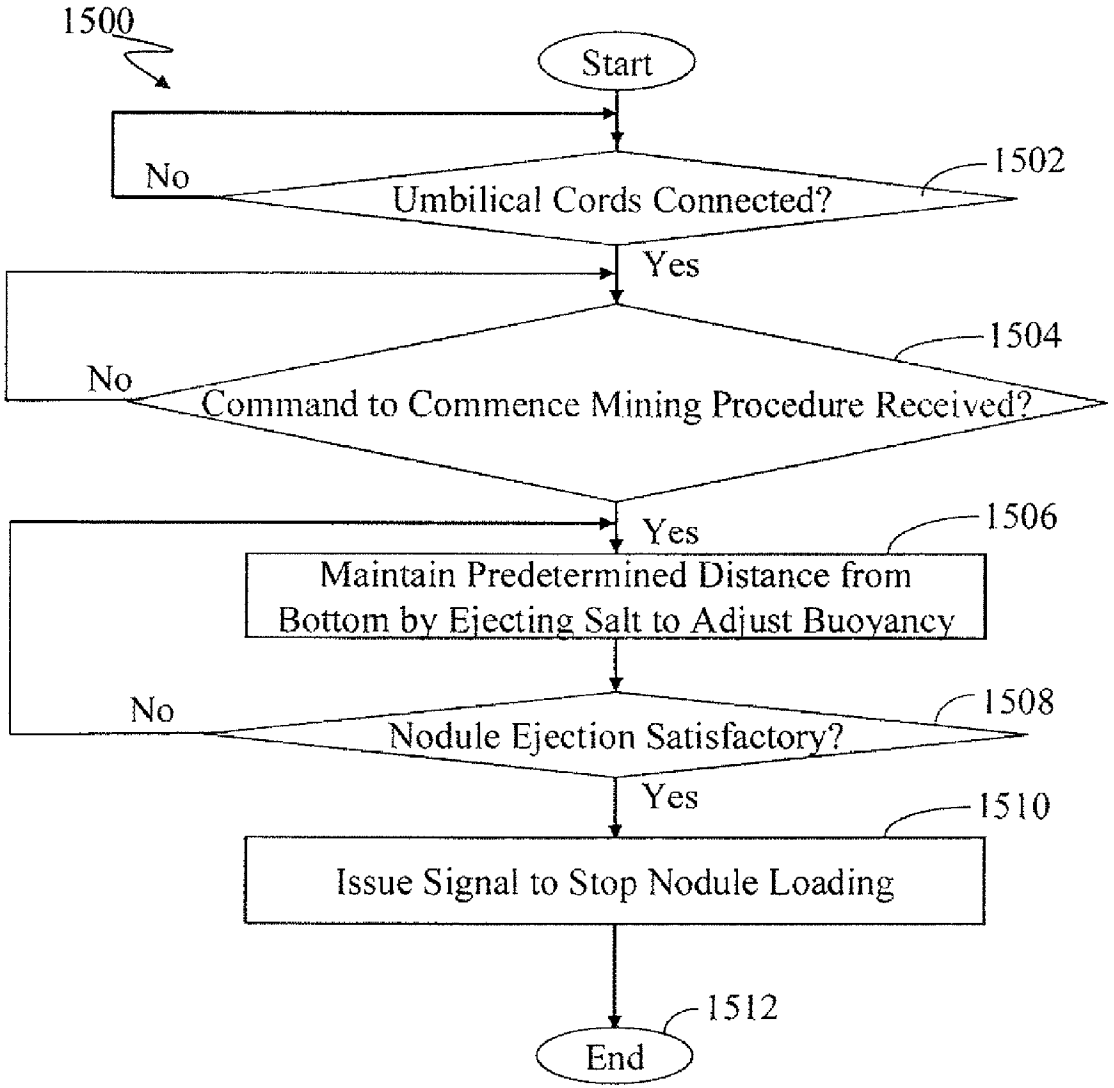
FIG. 15 shows an exemplary flow-chart of the container-controller during nodule loading.

FIG. 15 shows a flowchart 1500 of an exemplary process during mining operation. In step 1502, the process determines whether umbilical cords 130 has been successfully connected. As noted above, umbilical cords 130 provides a loading hose, a power line (either electrical or hydraulic), and a communication link. Processor 1302 and/or an operator may determine where possible that all functions supported by umbilical cords 130 are functioning. If the umbilical cords 130 have been successfully connected, the process goes to step 1504. Otherwise, if umbilical cords 130 have not been successfully connected, the process returns to step 1502. In step 1504, processor 1302 determines whether a command to commence mining procedure has been received. If the command to commence has been received, the process goes to step 1506. Otherwise, the process returns to step 1504. The command to commence mining procedure may be issued by an operator or a computer on ship 102.

In step 1506, processor 1302 maintains feet 420 of container 112 to be within a predetermined distance above bottom 108, and the process goes to step 1508. As discussed above, processor 1302 performs this task by activating screws 500 to eject salt as mined nodules 110 are being loaded into hopper 400 by mining-vehicle 128. Thus, processor 1302 controls a salt-ejection rate to counter balance a nodule-loading rate so as to adjust buoyancy of load-carrier 124 resulting in feet 420 being within the predetermined distance above bottom 108. At this time, processor 1302 also receives position information from sensor/detector interface 1310 relating to a position and/or orientation of container 112. If container 112 is more weighted toward one side, then processor 1302 sends commands through ejector interface 1306 to eject more salt from the more heavily weighted side so as to compensate for the uneven weight distribution.

In step 1508, the process determines whether nodules are being ejected by any of screws 500. As discussed above, detector 508 is associated with each screw 500 and illumines opening 502 with a light wavelength that distinguishes salt 302 from nodules 110. Processor 1302 may include a program to automatically identify when nodules 110 are being ejected or an operator may make the identification by viewing ejected materials (salt 302 and/or nodules 110). In any case, when nodules 110 are being ejected by some of screws 500 and salt 302 is being ejected by others, the screws 500 ejecting nodules 110 may be stopped and nodule loading may continue until remaining screws 500 begin to eject nodules 110. At this time, a nodule-loading rate may also be adjusted because ballast ejection rate is reduced. When a program in processor 1302 or an operator is satisfied with nodule ejection status, the process goes to step 1510. In step 1510, processor 1302 issues a stop-nodule-loading signal, and the process goes to step 1512 and ends. In the case where an operator determines that the nodule ejection is satisfactory, a command may be issue directly to mining-vehicle 128 to stop further loading nodules 110, and ends the process.

Figure 16:
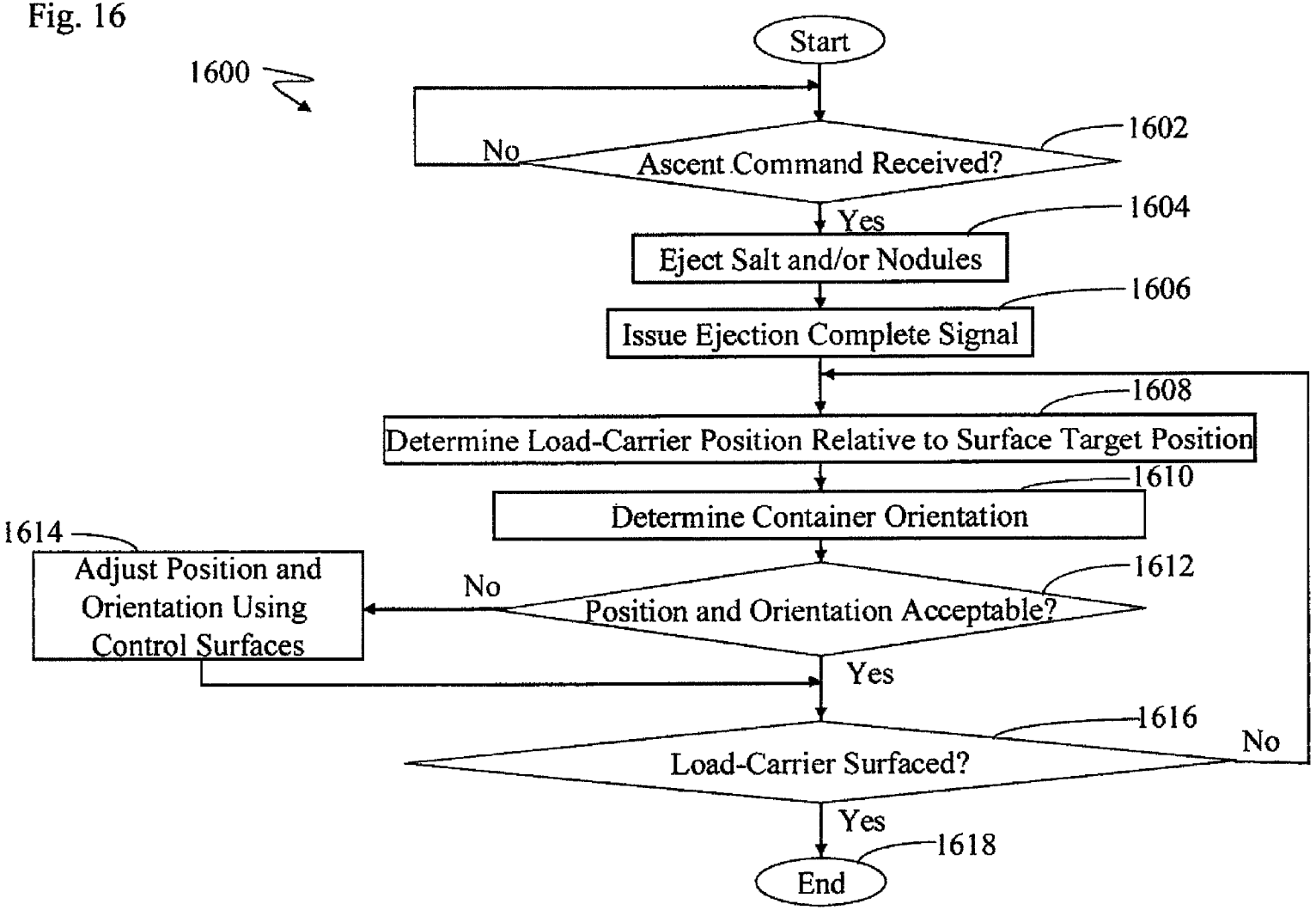
FIG. 16 shows an exemplary flow-chart of the container-controller for controlling the load-carrier during ascent to a surface of the ocean.

FIG. 16 shows a flowchart 1600 for an exemplary process of processor 1302 during ascent to surface 104. In step 1602, processor 1302 determines whether an ascent command has been received. If the ascent command is received, the process goes to step 1604. Otherwise, if the ascent command is not received, the process returns to step 1602. In step 1604, processor 1302 sends a command to ejector interface 1306 to activate screws 500 to eject nodules 110 and/or salt 302. Either a predetermine amount of nodules 110 and/or salt 302 are ejected, or processor 1302 continues the ejection until load-carrier 124 ascends at a predetermined rate such as one meter per second, for example. In either case, when the ejection action is stopped, the process goes to step 1606 and issues an ejection complete signal, and then the process goes to step 1608. As noted above, after the ejection complete signal is transmitted, ROV 132 disconnects umbilical cords 130 from container 112 and load-carrier 124 becomes load-carrier 118 which continues to ascend through ocean 106 until surface 104 is reached.

In step 1608, processor 1302 receives a surface target position signal from communication unit 1304 and determines a position of load-carrier 118 relative to the surface target position, and the process goes to step 1610. The surface target position signal may be generated from several sonar signals transmitted from surface 104 of ocean 106 such as ship 102 or other surface transmitters. The sonar signals may have a predetermined phase relationship, much like the GPS system so that processor 1302 may determine the position of load-carrier 118 relative to a desired surface position designated as the surface target position. The desired phase relationship may be transmitted to processor 1302 before umbilical cords 130 are disconnected, for example. In step 1610, processor 1302 receives position and orientation information from sensor/detector interface 1310, and the process goes to step 1612.

In step 1612, controller 422 determines whether the position of load-carrier 118 and the orientation of container 112 are acceptable, much like step 1406 of flowchart 1400 shown in FIG. 14. If acceptable, the process goes to step 1616. If unacceptable, the process goes to step 1614. In step 1614, processor 1302 sends commands through control surface interface 1308 to adjust control surfaces 426 to urge load-carrier 118 toward the surface target position and to assist in relieving any weight unbalance issues due to uneven nodule distribution in hopper 400, and the process goes to step 1616. In step 1616, processor 1302 determined whether load-carrier 118 has surfaced. If load-carrier 118 has surfaced, the process goes to step 1618 and ends. Otherwise, if load-carrier 118 has not surfaced, the process returns to step 1608. Processor 1302 can determine whether load-carrier 118 has surfaced by either receiving that information from controller 806 or by an included surface detector.

Figure 17:
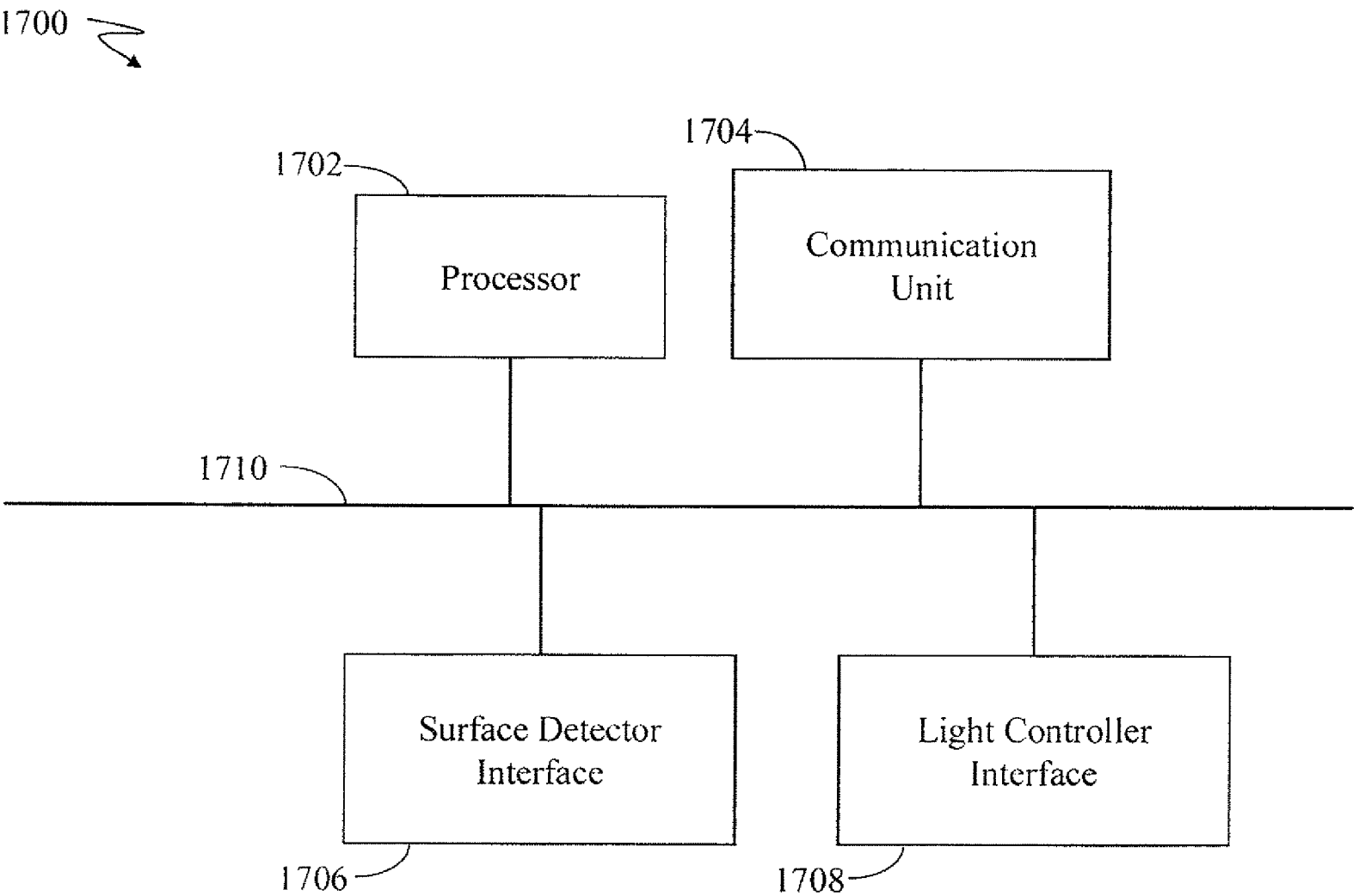
FIG. 17 shows an exemplary block diagram of an underwater-balloon-controller.

FIG. 17 shows and exemplary block diagram 1700 of controller 806. Controller 806 may include a processor 1702, a communication unit 1704, a surface detector interface 1706 and a light controller interface 1708. All of these components 1702-1708 may be interconnected through bus 1710. As discussed in connection with controller 422, a bus architecture is shown as an example, other component interconnections may be used as is well known. For example, a parallel connection between components may be used where high bandwidth may be required or where tight timing requirements are present. However, for low bandwidth and/or loose timing situations, serial connections may be used. Controller 806 may be implemented using various technologies such as PLAs, PALs, applications specific integrated circuits (ASICs), off the shelf processors, and/or software executed in one or more general purpose or special purpose processors using one or more CPUs, for example. Memory that is included in any component 1702-1708 may be implemented using hard disk, optical disk, and/or RAM/ROM in either volatile or nonvolatile technologies.

After the ascent command is received, processor 1702 activates a surface detector through surface detector interface 1706 to send a signal to processor 1702 when surface 104 is reached. When the signal is received indicating that surface 104 is reached, load-carrier 118 becomes load-carrier 126, and processor 1302 activates a light controller through light controller interface 1708 to determine whether lights 804 should be on or off. For example, if conditions above surface 104 is dark or under heavy fog, then lights are turned on. Lights may be always turned on as soon as surface 104 is reached. However, this may unnecessarily drain a battery powering controller 806 and lights 804.

After surfacing, processor 1702 commands communication unit 1704 to transmit a surface tracking signal via antenna 808 so that an operator on ship 102 may be alerted that load-carrier 126 is ready to be unloaded. The surface tracking signal may be encoded to identify the specific load-carrier 126 and also its position on surface 104 obtained from a GPS function within communication unit 1704, for example. In one embodiment, the surface tracking signal may be turned off when a detach-command is received from communication unit 1704. However, there may be many other methods for managing load-carriers 126. For example, there may be many load-carriers 126 on surface 104. Instead of each load-carrier 126 transmitting a surface tracking signal, ship 102 may issue a ping signal to solicit all load-carriers 126 to return an acknowledge signal. The acknowledge signal may include UPS coordinates, condition status of load-carrier 126 such as battery charge condition, any damage sustained, etc., so that an operator or a computer system may manage processing of load-carriers 126. In this case, load-carriers 126 do not transmit surface tracking signals but transmit the acknowledge signals when pinged.

In any case, when a detach-command is received, ship 102 is ready to process container 112 of load-carrier 126. As discussed above, ROV 134 tows load-carrier 126 into position relative to ship 102, attaches container 112 to hoist line 113 from ship 102, and detaches attachment 828 from container 112. At this time, underwater-balloon 116 joins other underwater-balloons 116 waiting for deployment. Processor 1702 may leave light controller activated and responds to any ping signal that may be received from ship 102. Lights 804 may be turned off while waiting for deployment if other lights satisfy safety requirements. For example, tether lines may include lights that mark an area where underwater-balloons 116 are parked. Underwater-balloon 116 may be towed into a holding position or attached to a tether line to prevent drifting away from the mining operation area.

If a deployment command is received through communication unit 1704, then processor 1702 waits until container 112 is attached to attachment 828 and detached from hoist line 113 of ship 102. Processor 1702 deactivates light controller 1708 (turn off lights) and becomes inactive until an ascend command is received.

Figure 18:
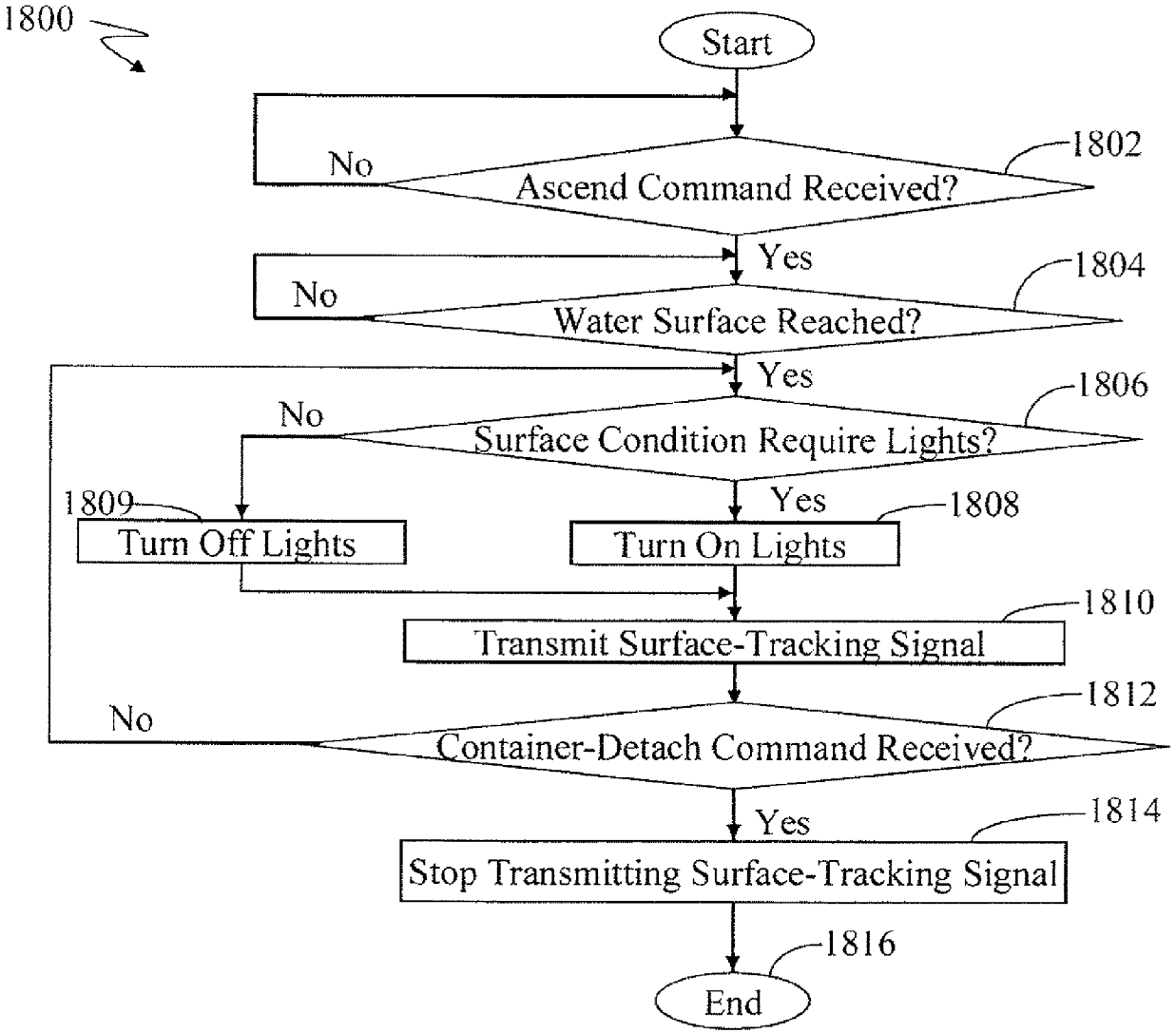
FIG. 18 shows an exemplary flow-chart of the underwater-balloon-controller during ascent to the surface of the ocean.

FIG. 18 shows a flowchart 1800 of an exemplary process of processor 1702 for ascending through ocean 106 with a load of nodules 110. In step 1802, processor 1702 determines whether an ascend command has been received. If an ascend command has been received, the process goes to step 1804. Otherwise, if the ascend command has not been received, the process returns to step 1802. In step 1804, processor 1702 determines whether a surfaced signal is received from surface detector 1706. If the surfaced signal is received, the process goes to step 1806. Otherwise, if surface 104 has not been reached, the process returns to step 1804.

In step 1806, processor 1702 activates light controller 1708 that checks surface conditions to determine whether lights 804 should be on or off. If lights should be turned on, the process goes to step 1808. Otherwise, if lights 804 do not need to be turned on, the process goes to step 1809. In step 1808, lights 804 are turned on and the process goes to step 1810. In step 1809, the lights are turned off, and the process goes to step 1810.

In step 1810, processor 1702 commands communication unit 1704 to transmit a surface-tracking signal, and the process goes to step 1812. As discussed above, there are other methods to deter nine whether and/or when the surface-tracking signal should be transmitted. In step 1812, processor 1702 determines whether a container-detach command has been received through communication unit 1704. If the container-detach command has been received, processor 1702 commands communication unit 1704 to stop transmitting the surface-tracking signal (if not already stopped) and goes to step 1816 and ends.

Figure 19:
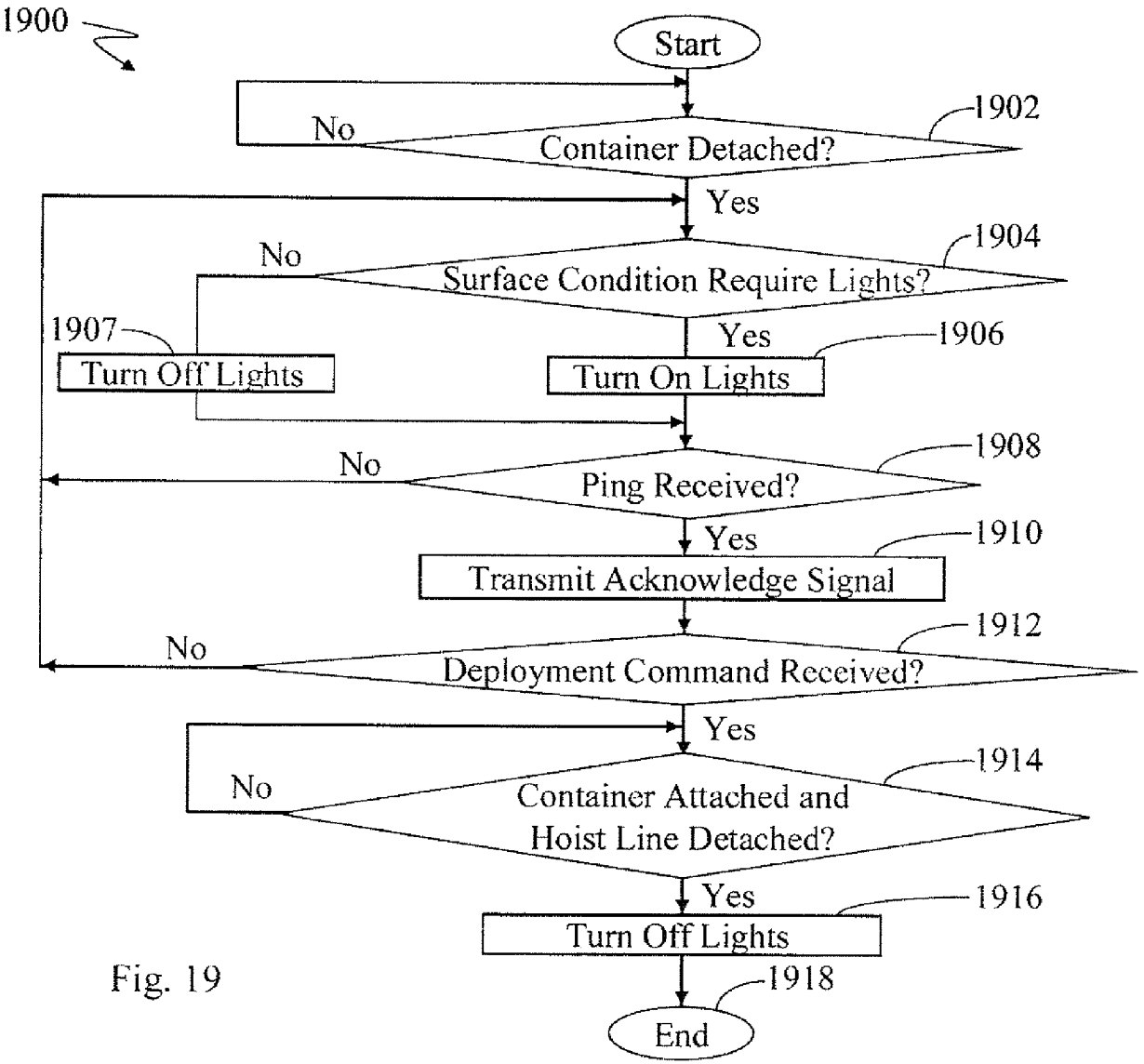
FIG. 19 shows an exemplary flow-chart of the underwater-balloon-controller after the container is detached.

FIG. 19 shows a flowchart 1900 of an exemplary process of controller 806 after detaching and then attaching container 112. In step 1902, processor 1702 determines whether container 112 loaded with nodules 110 has been detached from underwater-balloon 116. If container 112 has been detached, the process goes to step 1904. Otherwise, if container 112 has not been detached, the process returns to step 1902. In step 1904, processor 1702 maintains the active state of light controller 1708 that check if conditions on surface 104 require lights 804 to be on or not. If lights should be on, the process goes to step 1906, turns lights 804 on and goes to step 1908. Otherwise, if lights 804 should be off, the process goes to step 1907, turns lights off and goes to step 1908.

As discussed above, during this time, underwater-balloon 116 may be towed to an appropriate position to wait for a deployment command. In step 1908, processor 1702 waits for a ping signal. If a ping signal is received, the process goes to step 1910. Otherwise the process returns to step 1908. In step 1910, processor 1702 sends an acknowledge signal through communication unit 1704, and the process goes step 1912. The acknowledge signal may include information requested in the ping signal and/or status information of underwater-balloon 116. In step 1912, processor 1702 determines whether a deployment command has been received. For example, a deployment command may be imbedded in the ping signal where a specific underwater-balloon 116 is identified for deployment. If a deployment command is received, the process goes to step 1914. Otherwise, if the deployment command is not received, the process returns to step 1904. In step 1914, processor 1702 determines whether container 112 (loaded with salt 302) is attached to attachment 828 and hoist line 113 from ship 102 is detached. If the container 112 is attached and hoist line 113 is detached, the process goes to step 1916. In step 1916, processor 1702 commands light controller 1708 to turn lights off and the process goes to step 1918 and ends. Otherwise, if the container 112 is either not attached or hoist line 113 is not detached, the process returns to step 1914.

While the invention has been described in conjunction with exemplary embodiments, these embodiments should be viewed as illustrative, not limiting. Various modifications, substitutes, or the like are possible within the spirit and scope of the invention.

What is claimed is:

1. An underwater load-carrier apparatus comprising:
an underwater-balloon;
a container capable of carrying a load being removably attached to the underwater-balloon;
a controller that controls a buoyancy of the load-carrier and the load in water;
salt formed into an approximately round shape of about 5 cm in diameter and coated with a material that retards salt dissolution into the water; and
an ejector screw ejecting a portion of the salt to adjust the buoyancy of the load-carrier.

2. The apparatus of claim 1, further comprising a control surface, wherein the controller commands the control surface to control a position of the load-carrier.

3. The apparatus of claim 1 further comprising:
a connector of the container, the connector being connected to a loading hose to the load-carrier for loading the container.

4. The apparatus of claim 3 wherein the connector comprises a first portion for loading the container and a second portion for providing power and a communication link.

5. The apparatus of claim 1 further comprising a hydrophone, the hydrophone capable of communication under water and/or above water.

6. The apparatus of claim 1 further comprising a covering material forming a part of an external surface of the underwater-balloon, the external surface establishing a shape that adjusts a position of the underwater-balloon based on a current of the water relative to the underwater-balloon.

7. The apparatus of claim 1 further comprising:
nodules;
means for weighing down the container that acts as ballast;
means for ejecting the ballast into the water;
means for reduce clogging and/or jamming the means for ejecting;
means for detecting ejected material to distinguish between ballast and
means for urging the load-carrier toward a desired position;
means for sensing a position, an orientation, an attitude, an altitude, and a distance to a surface of the water;
means for detecting a bottom of an ocean;
means for preventing nodules and/or the ballast from escaping from the container;
means for connecting the container to an external device for loading, power, and communication;
means for opening the container to unload nodules;
means for the water to flow through the container; and
means for attaching the container to the underwater-balloon.

8. The apparatus of claim 1 further comprising:
means for forming a shape of the underwater-balloon that orientates the underwater-balloon relative to a water current;
means for towing the underwater-balloon;
means for adjusting buoyancy of underwater-balloon;
means for controlling the underwater-balloon;
means for communicating with an operator and/or with the container; and
means for attaching to the container.

9. The apparatus of claim 1, wherein the container is removably attached by cables that are threaded through holes of attachment portions of the container for removably attaching the container to the underwater-balloon.

* * * * *